United States Patent [19]

Wingerter et al.

[11] 4,283,188

[45] Aug. 11, 1981

[54] H-SECTION CARTON FORMING MACHINE

[75] Inventors: Conrad C. Wingerter; J. Thomas Bassett, both of Yakima, Wash.

[73] Assignee: Marq Packaging Systems, Inc., Yakima, Wash.

[21] Appl. No.: 29,633

[22] Filed: Apr. 13, 1979

[51] Int. Cl.[3] ..... B31B 7/02; B31B 7/26

[52] U.S. Cl. ..... 493/89; 493/92; 493/120; 493/126; 493/174

[58] Field of Search ..... 93/37 SP, 37 R, 51 R, 93/51 M, 51 HW, 47, 39 R, 55, 49 R; 229/15; 220/DIG. 25

[56] References Cited

U.S. PATENT DOCUMENTS

| | | | |
|---|---|---|---|
| 2,154,950 | 4/1939 | McDonald | 93/39 R |
| 2,600,954 | 6/1952 | Bardet | 93/44.1 R |
| 2,811,087 | 10/1957 | Nigrelli | 93/39 R |
| 2,885,932 | 5/1959 | Easter | 93/37 R |
| 2,896,519 | 7/1959 | Goss | 93/51 R |
| 3,029,711 | 4/1962 | Griese | 93/36 M |
| 3,069,980 | 12/1962 | Kendall et al. | 93/55.1 R |
| 3,134,308 | 5/1964 | Ali-Oglu | 93/37 R |
| 3,185,048 | 5/1965 | Struble | 93/37 R |
| 3,342,116 | 9/1967 | Roesner et al. | 93/55 |
| 3,400,639 | 9/1968 | Wainberg | 93/51 R |
| 3,400,640 | 9/1968 | Randles | 93/51 M |
| 3,411,663 | 11/1968 | Moore et al. | 220/15 |
| 3,511,138 | 5/1970 | Baker | 93/51 R |
| 3,590,700 | 7/1971 | Paxton et al. | 93/55 |
| 3,626,819 | 12/1971 | Hoyrup | 93/51 R |
| 3,659,505 | 5/1972 | Wasyluka et al. | 93/51 M |
| 3,763,749 | 10/1973 | Sawada | 93/51 R |
| 3,800,681 | 4/1974 | Corderoy | 93/51 R |
| 3,921,893 | 11/1975 | Randle, Jr. | 229/15 X |
| 3,952,634 | 4/1976 | Rollins et al. | 93/49 R |
| 3,965,803 | 6/1976 | Stone | 93/36 M |
| 4,154,148 | 5/1979 | Weremiczyk et al. | 93/37 SP |

*Primary Examiner*—James F. Coan

*Attorney, Agent, or Firm*—Christensen, O'Connor, Johnson & Kindness

[57] ABSTRACT

A machine for forming an H-section carton (19) from three corrugated blanks—two section blanks (21*a* and 21*b*) and a main body blank (23)—is disclosed. The machine has a generally L-shaped silhouette, with one leg of the L shape generally defining the path of travel of the section blanks and the other leg defining the path of travel of the main body blank. A supply of vertically oriented section blanks are located on opposing sides of the section blank leg. The two section blanks facing one another are simultaneously moved toward the main body blank leg, along parallel paths. The section blanks are first moved past glue heads (61*a* and 61*b*), which apply glue to the center region (22*a* and 22*b*) of the facing surfaces of the section blanks. Then, section forming mandrels (85) ram the section blanks toward one another into a U and H-section forming die (87). More specifically, the section modules first deform the section blanks into a U-shape. Then, the cross-members of the U-shaped sections are pressed together, whereby an H-shaped section is formed. While the H-section is being formed, a main body blank is removed from a supply of vertically oriented main body blanks and moved past glue heads (63*a*), which apply glue to edge tabs (49, 51, 53, 55, 57 and 59). Main body blank movement stops when the main body blank lies in front of a final forming die (94), which die is aligned with the H-section. When H-section formation is completed, an expandable mandrel (91) having a vertical slit picks up the H-section and rams it into the main body blank. Continued movement of the expandable mandrel rams the H-section and the main body blank into the final forming die, causing the edge tabs of the main body blank to be bent around the outer surface of the legs of the H-section. Thereafter, the expandable mandrel expands so as to press the legs of the H-section against the edge tabs.

28 Claims, 15 Drawing Figures

151
165
167
169
171
21b 75
21b
159
57a
157
163
161
164
149

75
173
175
177
179
135
189
187
147
141
137
143
145
185
183
181
153
165
167
21b
61b
157a
151
149
165a
61a
21a
139

H-SECTION CARTON FORMING MACHINE

TECHNICAL FIELD

This invention is directed to forming machines and, more particularly, to carton forming machines.

BACKGROUND OF THE INVENTION

In the past, a wide variety of forming machines suitable for forming corrugated cartons of various configurations from blanks (i.e., generally planar, and sometimes prescored, precut sheets of corrugated cardboard) have been proposed. However, none of these machines has been suitable for rapidly and quickly forming H-section cartons. One common type of H-section carton is known as the Bliss style tray with an integral "H" divider. More generally, an H-section carton includes a corrugated divider having an H-shape when viewed from above. The divider is enclosed by a main body formed of corrugated cardboard. The legs of the center H-section form one opposing pair of the outer walls of the overall carton and the main body forms the other opposing pair of outer walls, plus the bottom of the carton. The cross member of the H-section forms a center divider that bisects the carton. Cartons of this type are exceedingly strong and are being utilized more and more to house and store heavy containers, such as relatively large, liquid filled, plastic and glass bottles. Because the use of such cartons is becoming more and more widespread, obviously, a carton forming machine adapted to automatically form such cartons is desirable.

Therefore, it is object of this invention to provide an H-section carton forming machine.

It is a further object of this invention to provide a carton forming machine suitable for forming cartons having a configuration commonly referred to as a Bliss style tray with an integral "H" divider.

It is another object of this invention to provide a carton forming machine adapted to automatically form cartons comprising an enclosing main body and an integral H-section, the legs of the H-section functioning to form two opposing outer walls of the resultant carton.

SUMMARY OF THE INVENTION

In accordance with this invention, a machine for forming an H-section carton, such as a Bliss style tray with an integral "H" divider, is provided. The H-section carton is formed from three blanks—two section blanks and a main body blank. The carton forming machine is a generally L-shaped silhouette, with one leg of the L-shape defining the path of travel of the section blanks and the other leg defining the path of travel of the main body blank. Two section blanks are first formed into an H-section and, then, the H-section and a main body blank are joined at the intersection of the legs of the L-shaped machine.

In its preferred form, the machine includes supply hoppers located on either side of the section leg of the machine, the supply hoppers each supporting a supply of vertically oriented section blanks. The forming machine includes pickoff means for picking off the interiormost section blanks from each supply and simultaneously moving these two blanks along parallel paths past glue heads. The glue heads apply glue to the center region of the facing surfaces of the section blanks. The forming machine further includes section forming mandrels located on opposite sides of a U and H-section forming die. The U and H-section forming die is located downstream of the glue heads. After the section blanks have been moved past the glue heads, they are aligned between the section forming mandrels, on opposite sides of the U and H-section forming die. Then, the mandrels ram the blanks toward one another into the U and H-section forming die. The mandrels and the forming die first deform the interior blanks into U-sections and, then, press the adjoining legs of the U-sections together, whereby an H-section is formed.

While the H-section is being formed, a main body blank is moved from a vertically oriented supply of main body blanks past glue heads, which apply glue to edge tabs located along the upper and lower edges of the main body blank. The main body blank is moved to a position where it lies in front of a final forming die, which die is aligned with the H-section. More specifically, the main body blank stops when it reaches a position between the final forming die and an H-section formed in the manner described above.

After the H-section is formed and the main body blank is aligned between the H-section and the final forming die, a mandrel (which is preferably expandable) impinges on the H-section and rams it into the main body blank. Continued movement of the (expandable) mandrel rams the H-section and the main body blank into the final forming die. This co-action bends the main body blank around the H-section. The bending is such that the edge tabs of the main body blank overlie the legs of the H-section. Thereafter, the expandable mandrel expands and presses the legs of the H-section against the tabs.

In accordance with other aspects of this invention, the mandrel that rams the H-sections in the main body blanks includes a slit for receiving the cross member of the H-section. Further, the mandrel fills the interior space defined by the H-section. As a result, the mandrel applies at least part of the ram force to the main body blank, rather than the ram force being applied to the main body blank entirely via the H-section.

In accordance with further aspects of this invention, preferably, the pickoff members that move the interior blanks past the glue heads are pneumatically operated. Also, preferably, the section forming mandrels are pneumatically driven. Moreover, preferably, a main body blank is moved from the supply of main body blanks by a pneumatic mechanism that is vacuum coupled to the main body blank during movement. After being so moved, the main body blank is then moved past the glue heads by a chain-sprocket mechanism driven by an electric motor. Finally, preferably, the expandable mandrel is moved by a crank mechanism driven by an electric motor.

In accordance with still further aspects of this invention, preferably the U and H section forming die comprises a pair of upper and lower plates. In cross-section, the plates include planar central regions which lie parallel to one another. The central regions merge into wings that diverge away from one another. Further, preferably, in cross-section when viewed from above, the final forming die includes pairs of aligned upper and lower forming members that include outwardly diverging flanges facing the main body blank. In addition, preferably, the upper and lower surfaces of the final forming die are parallel and include ramp elements that assist the bending of the tabs of the main body blank outwardly when an H-section is rammed into a main body blank and the composite structure is rammed into the final forming die.

As will be appreciated by those skilled in the carton forming machine art from the foregoing description, the invention provides a machine for automatically and rapidly forming H-section cartons from corrugated blanks. The machine is relatively uncomplicated in that it merely requires an L-shaped frame adapted to support along one leg the elements necessary to form the H-section and along the other leg the elements necessary to apply glue to a main body blank. At the leg junction, the H-section is rammed into the main body blank and, thence, into a final forming die. The H-section is rapidly and quickly formed by merely moving two blanks past glue heads and, then, forming the H-section by forming the blanks into two U-shapes and attaching the two U-shaped sections together. Preferably, the frame members supporting the U and H-section and the final forming dies are such that the size of the dies can be easily changed. Such changes, plus changing the size of the mandrels allows a single machine to be used to form cartons of various sizes.

BRIEF DESCRIPTION OF THE DRAWINGS

The foregoing objects and many of the attendant advantages of this invention will become more readily appreciated as the same becomes better understood by reference to the following detailed description when taken in conjunction with accompanying drawings wherein.

DESCRIPTION OF THE PREFERRED EMBODIMENT

Figure 1:
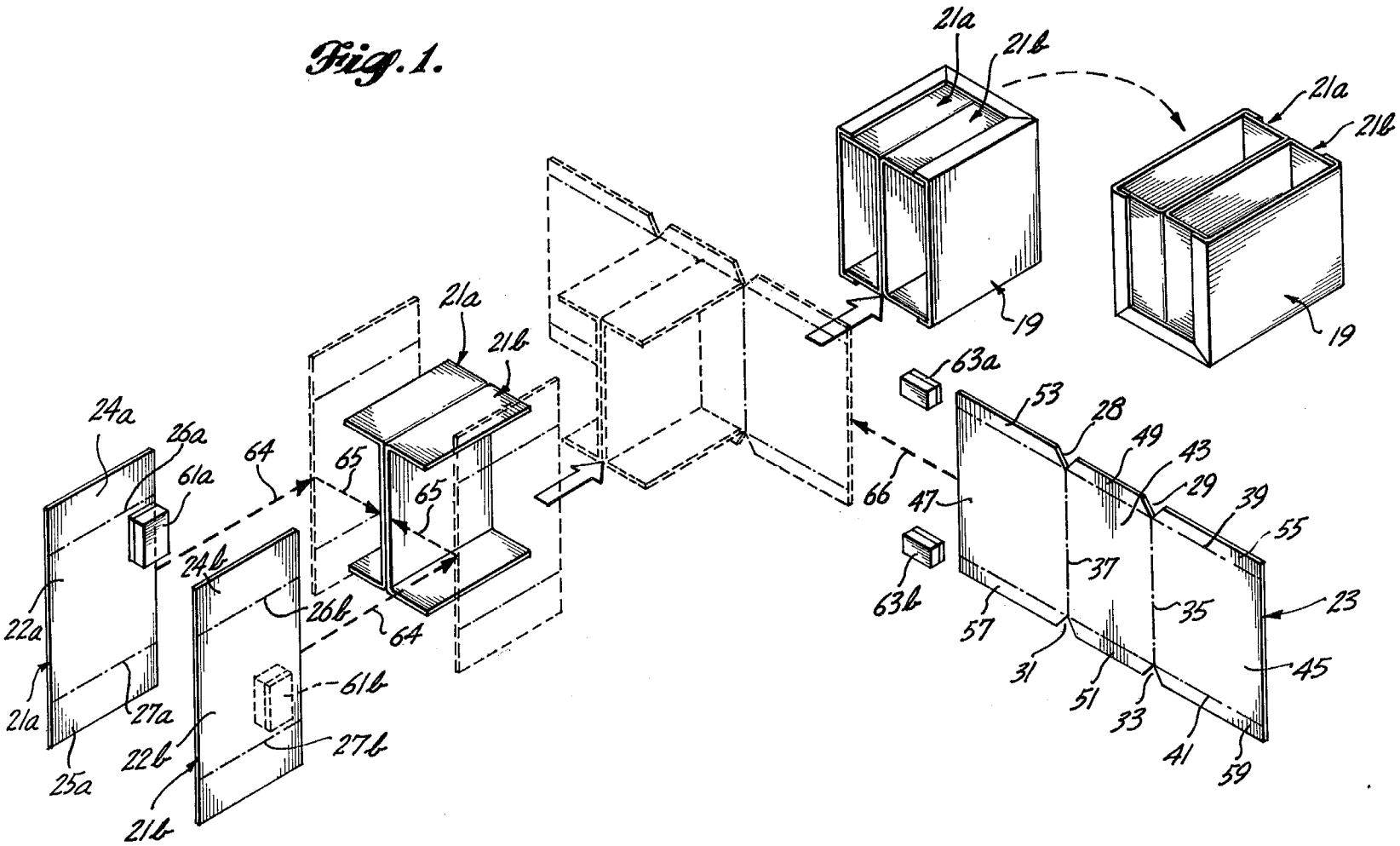
FIG. 1 is a pictorial diagram illustrating the formation of a Bliss style tray with an integral "H" divider by an H-section carton forming machine formed in accordance with the invention.

FIG. 1 is a pictorial diagram illustrating the steps that occur during the formation of H-section cartons 19 during the operation of an H-section carton forming machine formed in accordance with the invention. As can be seen in FIG. 1, an H-section carton 19 is formed of three separate corrugated blanks—two section blanks 21*a* and 21*b* and a main body blank 23. Prior to being formed, each section blank 21*a* and 21*b* is rectangular and positioned such that it lies in a vertical plane. Further, the section blanks are positioned such that the short edges of the blanks are horizontal and the long edges are vertical. Equally spaced from the upper and lower (short) edges of the section blanks, and lying parallel thereto, are upper bend creases 26*a* and *b* and lower bend creases 27*a* and *b*. The bends, which occur when a U-section and, then, an H-section is formed in the manner hereinafter described, occur along the upper and lower bend creases 26*a,b* and 27*a,b*. As a result, each section blank includes an upper panel 24*a,b*, lying between the upper bend crease 26*a,b* and the upper edge of the blank; a lower panel 25*a,b* lying between the lower bend crease 27*a,b* and the lower edge of the blank; and, a center panel 22*a,b* lying between the upper and lower bend creases.

The main body blank 23 is also generally rectangular and lies in a vertical plane. However, the longitudinal axis of the illustrated main body bank is horizontal. That is, the main body blank is positioned such that its long edges are horizontal and its short edges are vertical. The main body blank includes a spaced pair of V-shaped indentations 28 and 29 located along its upper edge, each of which is aligned with a related V-shaped indentation 31 and 33 located along its lower edge. Right and left (as shown) vertical creases 35 and 37 extend between the apexes of the indentations. In addition, an upper bend crease 39 spaced from and parallel to the upper edge of the main body blank lies along a line that intersects the apexes of the upper indentations 28 and 29. Similarly, a lower bend crease 41 spaced from and parallel to the lower edge of the main body blank lies along a line that interects the apexes of the lower indentations 31 and 33. Thus, the main body blank includes a center panel 43 defined by the right and left vertical bend creases 35 and 37 and the upper and lower bend creases 39 and 41. The main body blank also includes right and left (as shown) outer panels 45 and 47 defined by the vertical bend creases 35 and 37, the vertical edges of the main body blank, and the upper and lower bend creases 39 and 41. In addition to the center panel 43 and the right and left panels 45 and 47, the main body blank includes upper and lower center tabs 49 and 51 defined by the upper and lower (respectively) edges of the main body blank, the upper and lower (respectively) bend creases 39 and 41 and the inner edges of the upper and lower (respectively) V-shaped indentations 28, 29, 31 and 33. Finally, the main body blank includes upper and lower outer tabs 53, 55, 57 and 59. The upper and lower outer tabs are defined by the upper and lower (respectively) edges of the main body blank, the vertical edges of the main body blank, the upper and lower (respectively) bend creases 39 and 41 and the outer edges of the upper and lower (respectively) V-shaped indentations 28, 29, 31 and 33.

It will be appreciated that the foregoing description is relative and relates to the illustrated section and main body blanks. Thus, for example, the section blanks 21*a* and 21*b* could have a greater width than height dimension, as opposed to the illustrated greater heighth than width dimension. Similarly, the main body blank could have a greater heighth than width dimension, as opposed to the illustrated greater width then the heighth dimension. In any event, the width of the outer panels 45 and 47 is equal to the width of the interior blanks. Further, the height of the center panels 22*a* and 22*b* of the section blanks is generally equal to the distance between the upper and lower bend creases 39 and 41 of the main body blank. Also, the height of the end panels 24*a,b* and 25*a,b* of the section blanks are generally equal to one-half of the distance between the vertical bend creases 35 and 37 of the main body blank (unless the H-section is to extend above the main body blank after the carton is formed in the manner hereinafter described).

As will be better understood from the following description of a preferred embodiment of an H-section carton forming machine formed in accordance with the invention, when viewed from above, the H-section carton forming machine is generally L-shaped. Two section blanks 21*a* and 21*b* start out either side of one leg (the section leg) of the L-shaped machine. The section blanks 22*a* and 22*b* are then moved along the section leg past glue applicators 61*a* and 61*b* as illustrated by dashed arrow lines 64. One glue applicator 61*a* is located between the top of the center panel 22*a* of one of the section blanks 21*a* and the other glue applicator 61*b* is located near the bottom of the center 22*b* of the other section blank 21*b*. As a result, the glue applicators apply glue onto the center panels 22*a* and 22*b*. After glue has been applied, the section blanks are moved toward one another as illustrated by dashed arrow lines 65. As the section blanks are so moved, the upper and lower panels 24*a,b* and 25*a,b* bend outwardly. As a result, two back-to-back U-shaped sections are formed. The cross-sectional part of the U-shaped sections (formed by the center panels 22*a* and 22*b*) are pressed together and the glue causes the two sections to adhere to one another, whereby an H-section is formed. Because of the previously described dimensional relationship between the edges of the H-section and the center panel 43 of the main body blank, the rectangle defined by the H-edges of the H-section exactly match the outer periphery of the rectangular center panel 43 of the main body blank 23.

As the H-section is being formed a main body blank 23 is moved in the direction of dashed arrow line 66 along the main body blank leg of the L-shaped machine, past upper and lower glue applicators 63*a* and 63*b*. The upper and lower glue applications 63*a* and 63*b* only apply glue to the tabs 49, 51, 53, 55, 57 and 59 of the main body blank 23. The main body blank is moved along the main body blank leg of the L-shaped machine until it reaches a position where the central panel 43 of the main body blank is aligned with one edge of the H-section. Thereafter, the H-section is rammed into the main body blank and moves both items into a final forming die. The main forming die bends the center tabs 49 and 51 over the outer surfaces of one end of the -section. At the same time, the outer panels 45 and 47 of the main body blank are bent around the H-section so as to enclose the open sides of the H-section. Simultaneously, the outer tabs 53, 55, 57 and 59 are bent so they overlie the outer surface of the legs of the H-section. After the H-section and the main body blank are rammed into the final forming die, the legs of the H-section are pressed against the overlying tabs so that a tight glue joint is formed. Thereafter, the completed carton is removed from the H-section carton forming machine and inverted such that the open side of the box, which contains two chambers, can be entered from above, as illustrated in FIG. 1.

In summary, the H-section carton forming machine forms a carton by: applying glue to the facing center panels of two section blanks; forming the section blanks in U shapes and joining the U shapes together to form an H-section; ramming the H-section into the center panel of a main body blank and; thence, ramming both items into a final forming die, which bends the outer panels of the main body blank about the open sides of the H-section and simultaneously bends the tabs of the main body so that they overlie the outer walls of the H-section.

Figure 2:
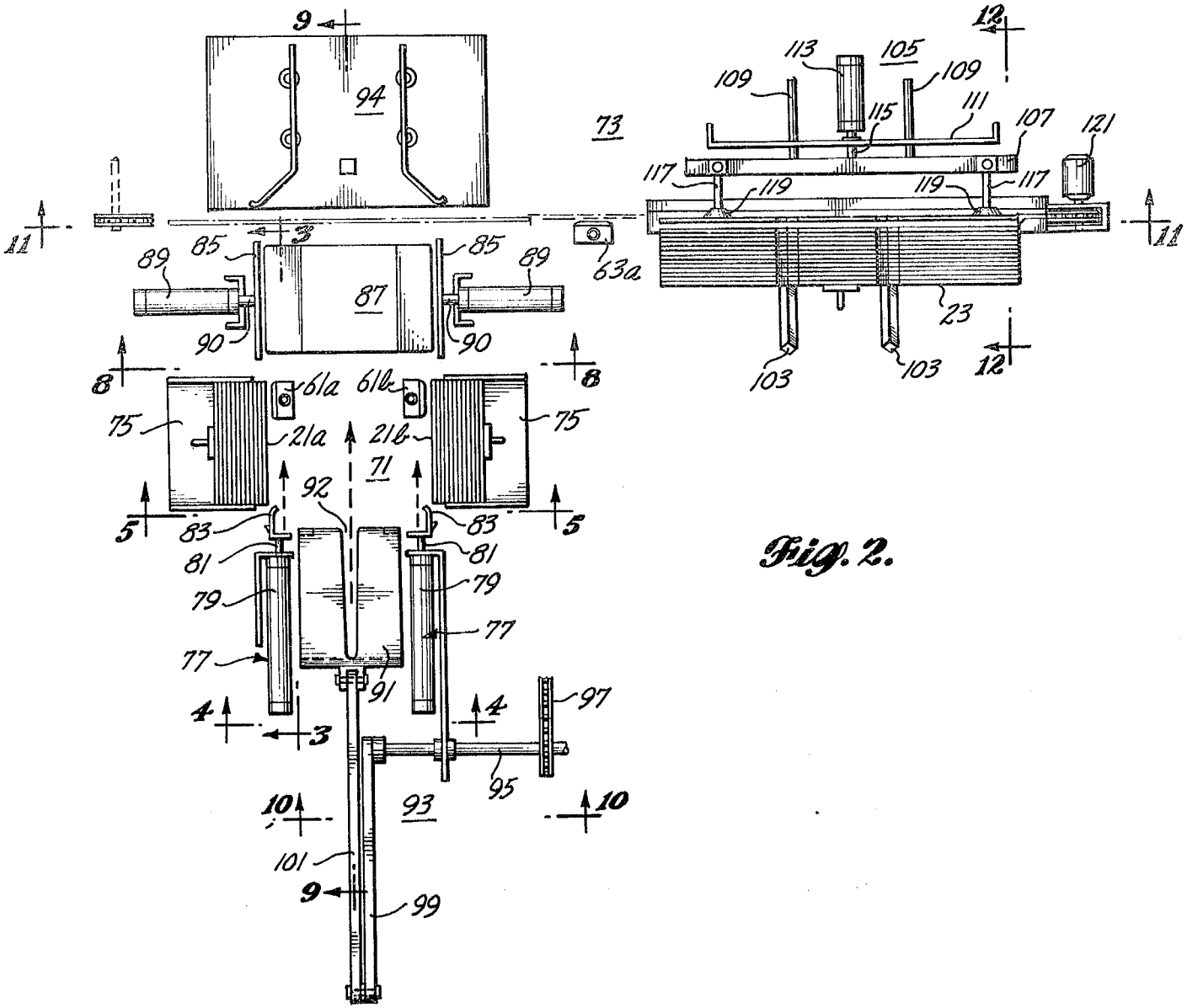
FIG. 2 is a top plan view illustrating the orientation of the major forming elements of an H-section carton forming machine formed in accordance with the invention.

FIG. 2 is a top plan view of an H-section carton forming machine formed in accordance with the invention. In order for the invention to be more readily understood, only the main forming elements are illustrated in FIG. 2, structural supports and other necessary elements being illustrated in FIGS. 3–14. As noted above, the H-section carton forming machine of the invention is generally L-shaped when viewed from above and includes a section leg 71 and a main body blank leg 73. Located on either side of the mid region of the section leg 71 is a supply of vertically oriented section blanks 21*a* and 21*b*. The supplies are aligned with one another and the lower edges of the section blanks are supported by inclined supply trays 75. Located inwardly of each supply of section blanks 21*a* and 21*b* are the section glue applicators 61*a* and 61*b*. Located toward the outer end of the section leg 71, generally in line with the innermost section blanks are pickoff mechanisms 77. Each pickoff mechanism 77 includes a horizontally mounted pneumatic actuator 79. The shafts 81 of the pneumatic actuators are connected to a foot 83, which faces the innermost section blank. The feet 83 pickoff and move the innermost section blank, past their respective glue applicators 61*a* and 61*b*, to a position whereat they each lie between a rectangular mandrel 85 and a common U and H-section forming die 87.

The rectangular mandrels are flat and vertically oriented. The mandrels 85 are driven by horizontally oriented pneumtic actuators 89. More specifically, the shafts 90 of the pneumatic actuators are attached to the outer surfaces of the rectangular mandrels, which face one another. The orientation is such that the shafts 90 of the pneumatic actuators 89 lie orthogonal to the longitudinal axis of the section leg 71. Located between the rectangular mandrels 85 is the U and H-section forming die. Further, the rectangular mandrels 85 and the U and H-section forming die 87 lie between the section glue applicators 61*a* and 61*b* and the main body blank leg 73 of the overall H-section carton forming machine.

In operation, after two section blanks have been moved by the pickoff mechanisms 77 to a position such that the section blanks lie on opposite sides of the U and H-section forming die 87 and in line with the rectangular mandrels 85, the pneumatic actuators 89 are energized. Energization of the pneumatic actuators 89 causes the rectangular mandrels 85 to move toward one another. This action rams the section blanks into the U and H-section forming die. As this ramming action occurs, the section blanks are formed in U-shapes; and, then the U-shapes are joined to form an H-section, as illustrated in FIG. 1 and heretofore described.

Mounted for movement along the longitudinal axis of the section leg 71 is an expandable mandrel 91. The expandable mandrel functions to ram the H-section into a main body blank and, thence, both items into a final forming die 94, whichis located at the junction between the section leg 71 and the main body blank leg 73. The expandable mandrel 91 is driven by a crank mechanism 93. The crank mechanism includes a rotatable shaft 95 connected to a motor (not shown in FIG. 2) by a chain 97. The shaft lies along an axis lying orthogonal to the longitudinal axis of the section leg 71, outward from the pickoff mechanisms 77. Mounted on the inner end of the shaft 95 (which is located on one side of the longitudinal axis of the section leg) is one end of a crank arm 99. The other end of the crank arm 99 is horizontally pinned to the outer end of a link 101, which lies along the longitudinal axis of the center leg 71. The other (inner) end of the link 101 is pinned by a horziontal pin to the rear end of the expandable mandrel 91. As illustrated in FIG. 2, the expandable mandrel 91 includes a vertical slit 92. The vertical slit 92 is adapted to receive the cross member of the H-section, which is vertical after the H-section is formed. Thus, the expandable mandrel 91 fills the interior space of the H-section, when an H-section is picked up by the expandable mandrel and rammed into a main body blank.

In operation, when the motor coupled to the shaft 95 by the chain 97 is energized, the shaft is rotated and the crank arm 99 applies a force to the link 101. As a result, the expandable mandrel is moved from its retracted position whereat it lies between the pickoff mechanisms 77, toward the H-section. Continued movement rams the mandrel into the H-section, the H-section into a main body blank, and both items into the final forming die 94. After one complete revolution of the shaft 95, the application of energy to the motor ends. At this point, the expandable mandrel is again in its retracted position whereat it lies between the pickoff mechanisms. When in this position, the crank arm 99 lies alongside of the link 101.

A supply of main body blanks 23 are supported by a pair of inclined square tubes 103 that extend outwardly from the inner side of the main body blank leg 73. The square tubes 103 are oriented and positioned such that they receive the V-shaped indentations 31 and 33 formed in the lower edge of the main body blanks 23, as previously described. The innermost one of the supply of main body blanks is removed from the supply by a withdrawal mechanism 105. The withdrawal mechanism includes a horizontal bar 107 lying parallel to, but spaced from, the supply of main body blanks 23. The horizontal bar 107 is supported by a pair of horizontal rods 109 slidably mounted in a horizontal frame member 111. Mounted on the frame member 111 is a pneumatic actuator 113, the shaft 115 of which is affixed to the horizontal bar 107. The actuator 103 is located between the horizontal rods 109 and on the side of the frame member opposite to the side on which the horizontal bar 107 lies. Extending horizontally outwardly from either end of the horizontal bar 107 is a hollow pneumatic tube 117. Located on the outer ends of the vacuum tubes 117 are suction cups 119. The vacuum tubes and suction cups 119 are positioned such that the suction cups can impinge on the innermost one of the supply of main body blanks 23, when the suction cups are moved toward the supply of main body blanks.

In operation, when the pneumatic actuator 113 is energized, the horizontal bar 107 is moved toward the supply of main body blanks. When the suction cups 119 contact the innermost one of the supply of main body blanks 23, that blank is gripped by the suction cups 119, as a result of the vacuum created by the vacuum tubes, which are connected to a suitable vacuum source (not shown). Thereafter, the pneumatic actuator 113 reverses direction and the innermost main body blank is pulled away from the supply of main body blanks 23. Main body blank movement ends when the removed main body blank 23 is aligned in a channel. Thereafter vacuum continues until a flight dog mounted on a chain located in the bottom of the channel is within a predetermined distance (e.g., 2 inches) of the main body blank. At this time the vacuum ends and the main body blank is released. Next, the flight dog mounted on a chain located at the bottom of the chennal impinges on the outer lower corner of the main body blank. As the chain is driven by a drive mechanism 121, hereinafter described in more detail, the impinging dog causes the main body blank to slide down the channel, past the glue applicators **63*a* and 63*b*. After moving past the glue applicators 63*a* and 63*b*, the main body blank is aligned between the H-section and the final forming die 94. Thereafter, as previously described, the expandable mandrel 91 rams the H-section into the main body blank and, thence, both items into the final forming die 94** whereupon the carton is completed.

FIGS. 3–14 illustrate in more detail a preferred embodiment of an H-section carton forming machine formed in accordance with the invention. However, prior to describing these figures, it is pointed out that for purposes of clarity, background items are not shown in these cross-sectional views. That is, the figures illustrate the arrangement of elements located at or near the cross-section plane indicated. In order to avoid undue complexity and confusion, background elements that would normally be seen through the cross-section plane are not, in most instances, illustrated.

FIGS. 3–8 illustrate in detail the pickoff mechanism 77, which moves the section blanks past the glue applicators **61*a* and 61*b*; and, the H-section forming mechanism. More specifically, the illustrated preferred embodiment of an H-section carton forming machine comprises a framework 131 that includes a base 133, a plurality of uprights 135 and a top 137. The base 133 and the top 137 may be frames formed of various shaped (e.g., U-shaped) channels, for example. The uprights 135 may also be formed of various shaped channels, which may or may not be continuous in cross-sectional size from top to bottom. In addition, various braces, as necessary are included. The channels forming the base, top and uprights may be bolted or welded together as desired. In any event, the uprights 135 support the top 137 a predetermined distance above the base 133. Extending between the top 137 and the base 133 are four vertical shafts 139. The shafts 139 are journaled in bearings 147 mounted in the base and top. Further, the shafts are threaded, one end being threaded in one direction, e.g., right-handed, and the other end being threaded in the opposite direction, e.g., left-handed. The different threaded regions meet at the center of the shafts 139. A sprocket 141 is mounted on each of the threaded shafts 139, near the upper end thereof, inside of the top 137. The sprockets are joined by a chain 143. A hand wheel 145 is coaxially mounted on the upper end of one of the shafts. As a result of the sprocket/chain coupling arrangement, rotation of the wheel 145 causes all of the shafts 139 to rotate simultaneously. Mounted below the midpoint of all four shafts is a lower table 149. Mounted above the midpoint of the shafts 139 is an upper table 151. The tables are mounted on the shafts via nuts 153, located in the four corners of the tables. As a result, when the shafts 139** are simultaneously rotated in the manner previously described, the tables move toward and away from one another, depending upon the direction of shaft rotation. Hence, the table separation distance is adjustable.

Figures 5, 6, 7:
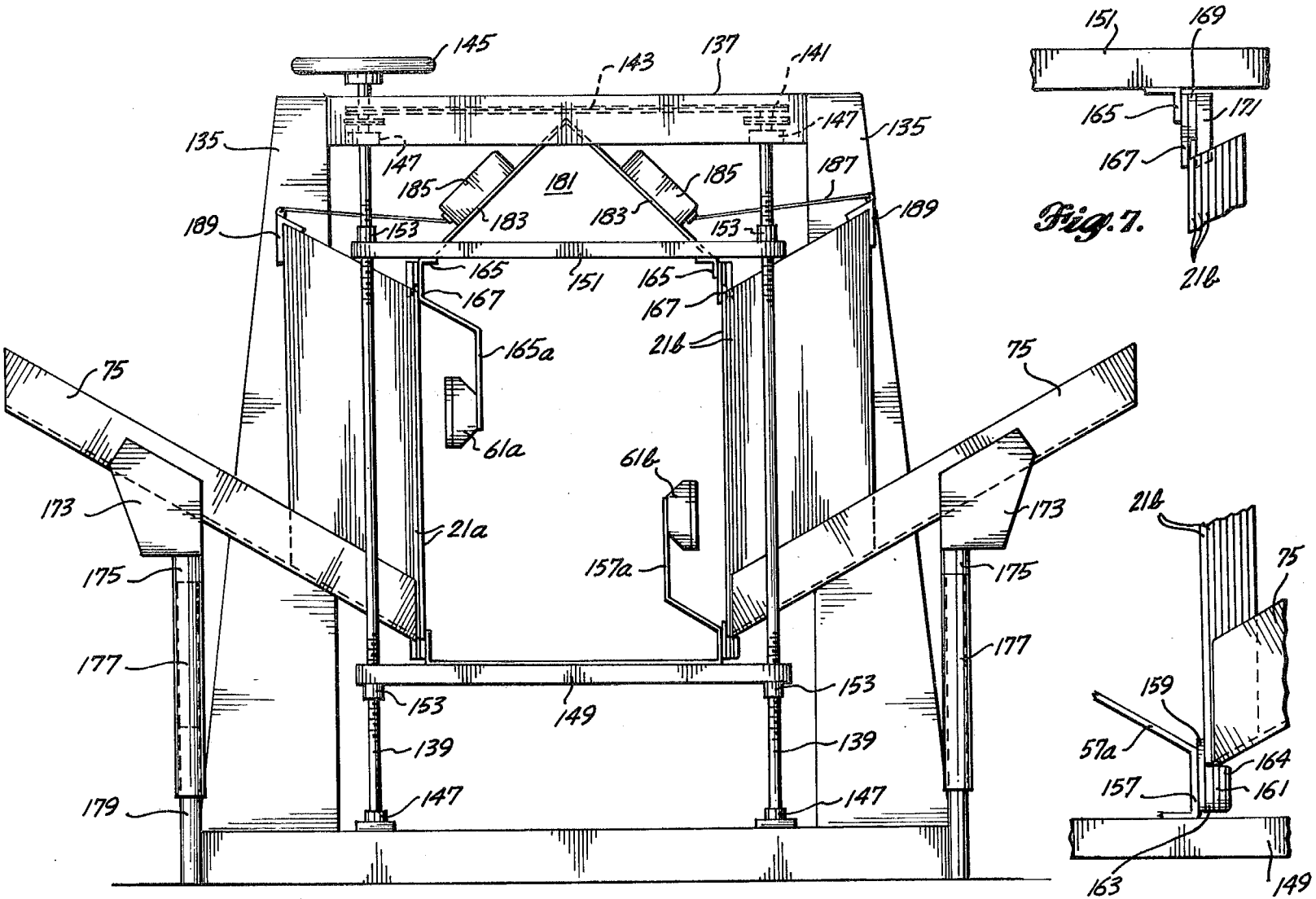
FIG. 5 is a cross-sectional view of an H-section carton forming machine formed in accordance with the invention taken along line 5—5 of FIG. 2.
FIG. 6 is an enlarged, partial, cross-sectional view of a lower channel for receiving the lower edge of a section blank from a section blank supply tray taken along line 5—5 of FIG. 2.
FIG. 7 is an enlarged, partial, cross-sectional view of an upper channel for receiving the upper edge of a section blank taken along line 5—5 of FIG. 2.

As best illustrated in FIG. 5, the inner end of the section blank supply trays 175 are affixed to the upper surface of the lower table 149 at spaced apart locations. From this region, the trays 155 incline upwardly and outwardly. As shown in FIG. 6, mounted atop the tables 149 are right angle brackets 157, which lie parallel to the direction of movement of the interior blanks 21*a* and *b*. Mounted on the outer surface of the vertical leg of the angle brackets 157 is a plate 159. The plate extends above the lower surface of the supply trays 75, which are generally U-shaped when viewed in cross-section. The plates act as stops for the lower inner corner of the supply of section blanks supported by the supply trays. The bottom inner end of the supply trays include a downwardly projecting flange 161. Located between the downwardly projecting flange 161 and the plate 159 is a spacer bar 163. The top of the spacer bar is generally co-planar with the top of the bottom of the supply trays and slightly thicker than the thickness of the corrugated cardboard used for the section blanks. Bolts 164 or other suitable elements join these structural members together.

As will be understood from the foregoing description and viewing FIG. 6, the innermost section blank of a supply of sections blanks presses against the plate 159 and lies atop the spacer bar 163. As illustrated in FIG. 7, a generally similar arrangement is formed beneath the upper table 151. That is, mounted beneath the upper table are right angle brackets 165, which vertically support relatively wide plates 167. Located next to the relatively wide plate 167 is a relatively narrow spacer bar 169. A wide outer bar 171 extends below the narrow spacer bar, whereby a channel is formed.

Arm extensions forming part of the angle brackets 157 and 165 support the upper and lower glue applicators 61*a* and 61*b*. More specifically, the lower glue applicator 61*b* is supported by an inwardly and upwardly extending arm 157*a* and the upper glue applicator 61*a* is supported by an inwardly and downwardly extending arm 165*a*. The arms may be unitary (e.g., part of) the angle bracket or may be attached thereto.

The trays 75 are supported in their midregion by a pair of sideplates 173, one attached to either side of the trays. The lower ends of the side plates 173 are supported by a horizontal bar 175. The center of the horizontal bar 175 is supported by a telescoping upright 177. As a result, when the lower table is moved up and down, the telescoping uprights allow the trays 155 to move. A suitable locking arrangement (not shown) allows the telescoping uprights to be locked when the desired tray position is reached.

Mounted atop the upper table 151 is a retraction mechanism 181. The retraction mechanism comprises a pair of joined inclined plates 183, which may be formed in a unitary manner. Mounted on the outer surfaces of the inclined plates are retraction reels 185. The retraction reels are spring-loaded reels that include cables 187 adapted to be pulled outwardly so as to overlie the supplies of section blanks 21*a* and 21*b*. Attached to the outer ends of the cables 187 are acute angle hooks 189. The acute angle subtended by the angle hooks is generally equal to the acute angle defined by the upper outer corner of a supply of section blanks supported by a supply tray 75. The angle hooks 189 overlie the upper outer corners of the supplies of section blanks, whereby the retraction reels 185 apply a force against the upper outer corners of the supplies. As a result, each supply is pressed against the upper wide plate 167, whereby the section blanks are maintained vertical.

Figure 3:
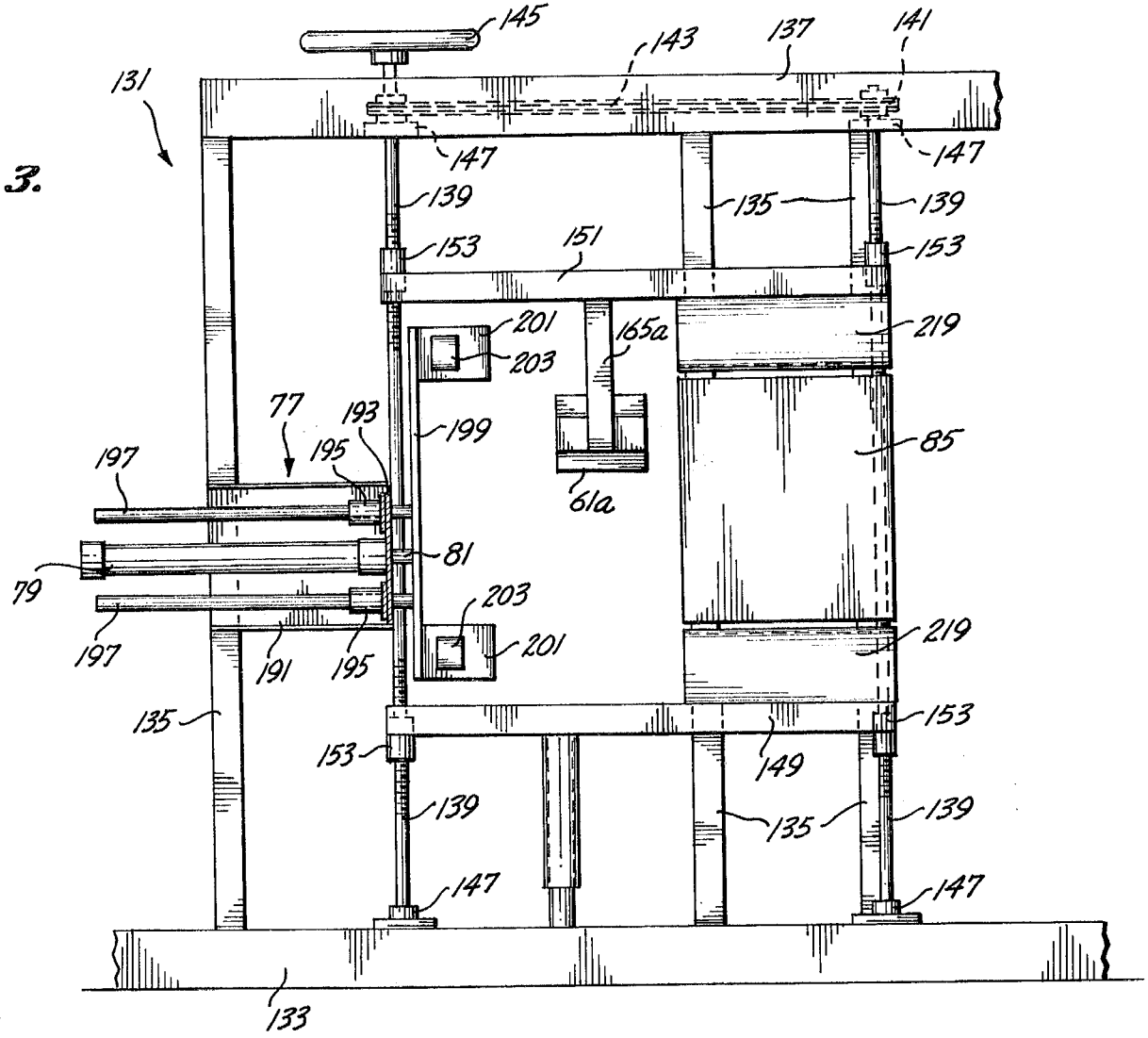
FIG. 3 is a vertical cross-sectional view of an H-section carton forming machine formed in accordance with the invention taken generally along line 3—3 of FIG. 2.
Figure 4:
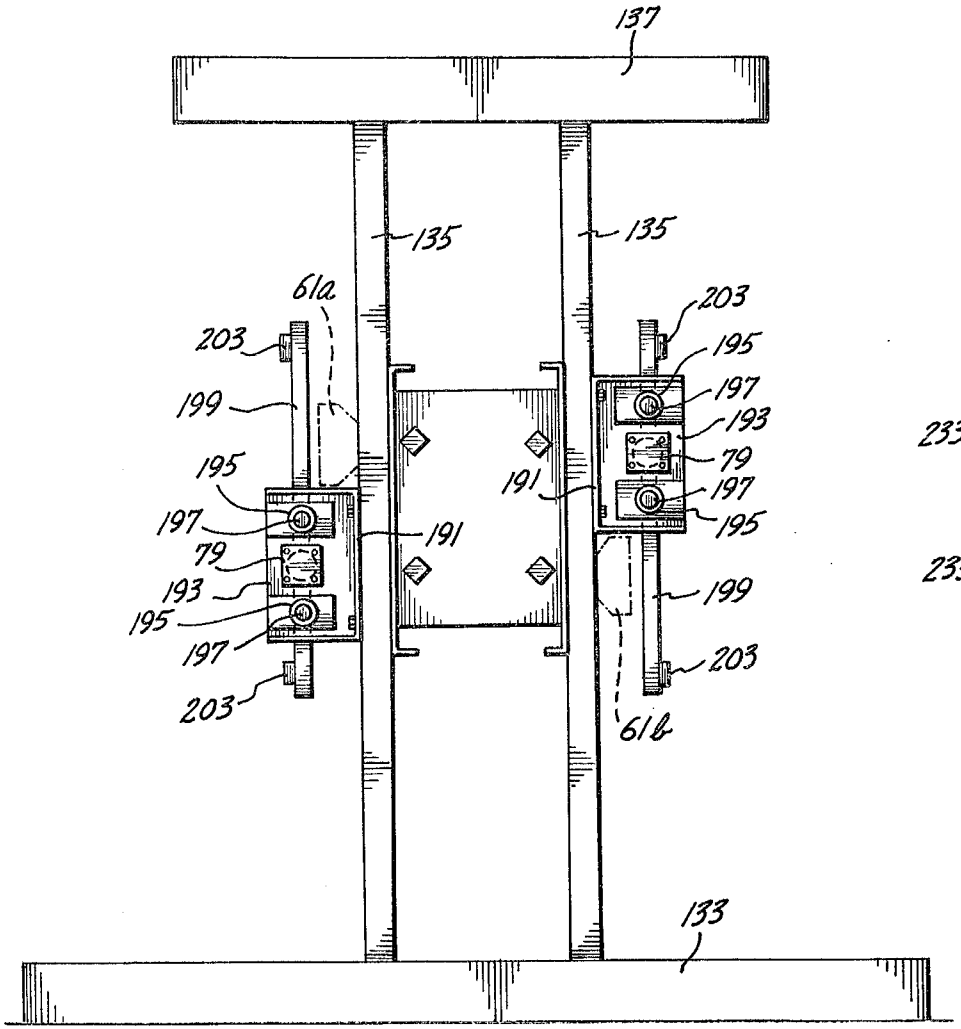
FIG. 4 is a partial cross-sectional view of an H-section carton forming machine formed in accordance with the invention taken along line 4—4 of FIG. 2.

FIGS. 3 and 4 illustrate the pickoff mechanisms 77. In addition to the pneumatic actuator 79, each of the pickoff mechanisms 77 includes a plate 191 mounted on one (or more) of the uprights 135. The plate includes a vertical flange 193 that lies orthogonal to the longitudinal axis of the section leg 71. The pneumatic actuator 79 is mounted on the vertical flange 193 so as to lie parallel to the longitudinal axis of the section leg 71. Mounted above and below (and parallel to) the pneumatic actuator 79 are tubular guides 195. The tubular guides 195 support upper and lower guide rods 197. The adjacent ends of the guide rods 197 and the shaft 81 of the pneumatic actuator 79 are affixed to a vertical plate 199, which forms the pickoff 83. Projecting outwardly from the vertical plate 199 are vertical pickoff feet 201. The plane of the pickoff feet is parallel to the longitudinal axis of the section leg 71 and the outer surfaces of the pickoff feet 201 are co-planar with the inner surfaces of the innermost ones of the supplies of section blanks. Projecting outwardly from the pickoff feet 201 are pickoff elements 203. The pickoff elements extend outwardly by an amount generally equal to the thickness of a corrugated section blank. Preferably, the vertical plate 199, the pickoff feet 201 and the pickoff elements 203 are formed of a piece of sheet metal bent into the desired shape. In any event, it will be appreciated from the foregoing description that the pickoffs are formed so as to impinge on the outer vertical edges of the innermost ones of the supplies of section blanks. Such impingement starts when the pneumatic actuators and, thus, the pickoffs are retracted. In the retracted position, the pickoffs or vertical plates 199 are in their most outward position. When the pneumatic actuators 79 are energized, they move the vertical plates 199 inwardly (from left to right as viewed in FIG. 3). As a result, the innermost blanks of the supply of sections blanks are moved inwardly, i.e. toward the main body blank leg 73. As the two section blanks are moved, as previously described, the glue applicators 61*a* and 61*b* spray glue into the center panels 22*a* and 22*b* of the blanks. Section blank movement ends when the blanks are aligned between the rectangular mandrels 85 and the U and H-section forming die 87.

While not illustrated, a microswitch is closed when the section blanks start to move. Such closure causes the glue applicators to spray glue. When the trailing edge of the section blanks reach the end of the glue applicators, another microswitch opens and glue spraying ends.

Figure 8:
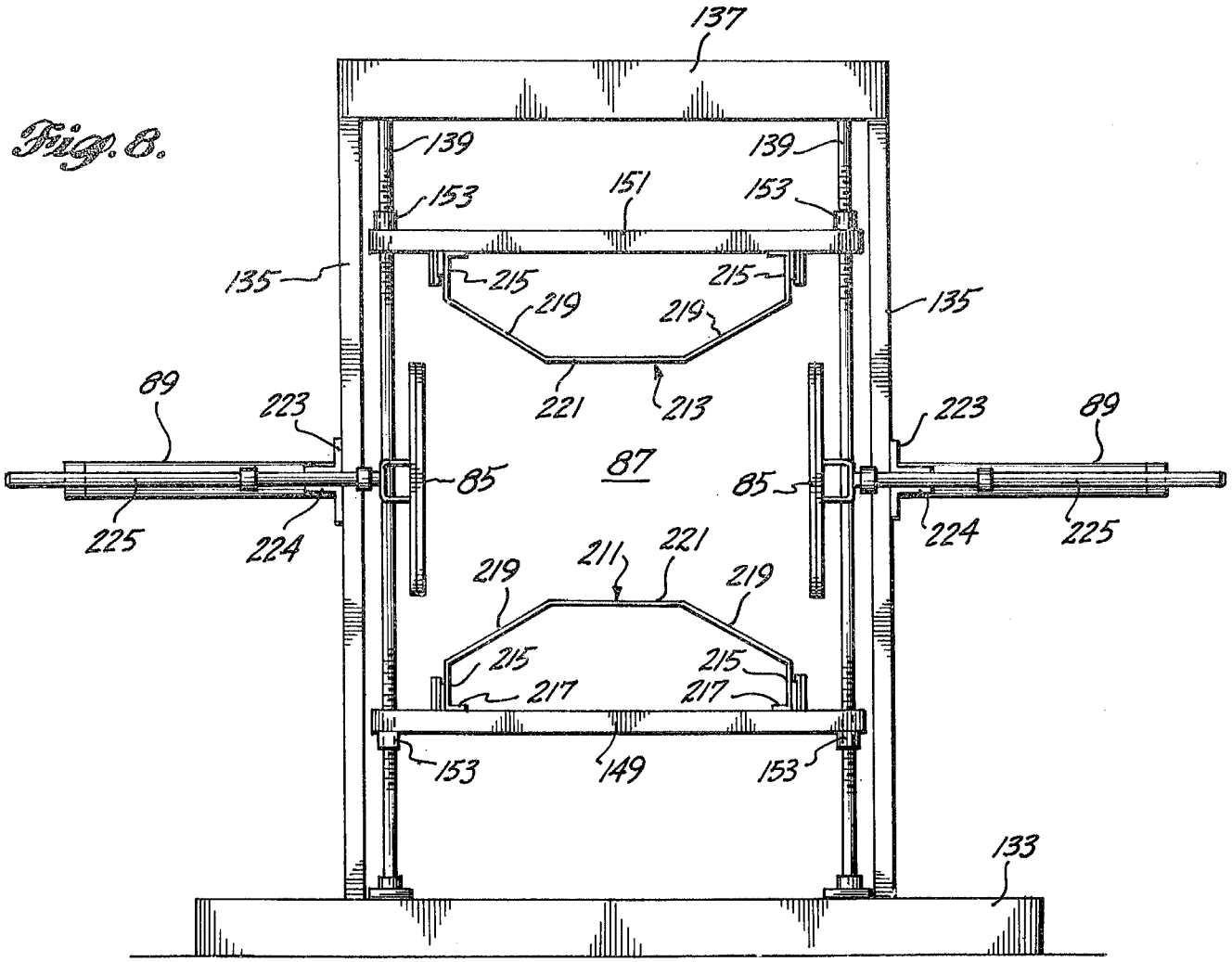
FIG. 8 is a cross-sectional view of an H-section carton forming machine formed in accordance with the invention taken along line 8—8 of FIG. 2.

The U and H-section forming die 87 is best illustrated in FIGS. 3 and 8. As illustrated therein, the U and H-section forming die includes a lower die element 211 and an upper die element 213. The lower die element 211 is mounted atop the lower table 149 and the upper die element 213 is mounted beneath the upper table 151. Preferably the die elements are of sheet metal. When viewed in a cross-sectional plane (FIG. 8) lying orthogonal to the longitudinal axis of the section leg, each die element includes a pair of vertical legs 215, which abut the inner side of the spacer bars 163 and 169 forming part of the channel in which the section blanks are moved. In this regard, the wide plates 159 and 167 may be extensions of the vertical legs 215 of the dies 211. In any event, the vertical legs of the lower die element 211 project upwardly and the vertical legs of the upper die element 213 project downwardly. Flanges 217 project inwardly from the vertical legs and, in the case of the lower die element, lie atop the lower table 149. In the case of the upper die element 213, the flanges lie beneath the upper table 151. The flanges are used to attach the die elements to the tables. Wings 219 extend inwardly from the facing edges of the vertical legs 215. More specifically, in the case of the lower die element 211, the wings 219 taper upwardly toward one another. In the case of the upper die element 213, the wings 219 taper downwardly toward one another. The wings 219 are terminated by horizontal plates 221. The horizontal plates are spaced from one another by an amount equal to the height of an H-section. Further, the width of the upper plates along a line orthogonal to the section leg 71 is substantially equal to the width of an H-section, i.e., the "height" of the legs of the H-section.

As illustrated in FIG. 8, the rectangular mandrels 85 are aligned with the space between the horizontal plates 221 of the die elements 211 and 213. The height of the rectangular mandrels 85 is substantially equal to the interior distance between the legs of an H-section. As discussed above, the rectangular mandrels 85 face one another and are moved by pneumatic actuators 89. More specifically, the pneumatic actuators 89 are horizontally mounted on plates 223 that extend between pairs of uprights 135. Mounted on either side of the actuators 189 are tubular guides 224. The tubular guides are horizontally mounted on the plates 223 and slidably mounted in the tubular guides are guide rods 225, only one of which can be seen in FIG. 8. The rectangular mandrels are mounted on the inner ends of the guide rods and the shafts of the pneumatic actuator 89. The guide rods, of course, maintain lateral alignment and prevent twisting of the rectangular mandrels 85 as the mandrels are moved toward and away from one another during the formation of U and H-sections.

In operation, after the two section blanks are positioned between the rectangular mandrels 85 and the U and H-section forming die 87, the pneumatic actuators 89 are energized. When they are energized, the pneumatic actuators move the rectangular mandrels toward one another, as previously described. This action rams the section blanks into the U and H-section forming die. As the section blanks are so moved, the wings 219 cause the upper and lower panels 24*a, b* and 25*a, b* to bend outwardly. Further movement of the section blanks causes the blanks to take on a back-to-back U-shaped configuration. When the vertical cross-members of the U-shaped sections meet, they are tightly pressed together, whereby a strong glue joint is formed. Thereafter, the pneumatic actuators withdraw the rectangular mandrels, leaving the now formed H-section in the center of the U and H-section forming die.

Figure 10:
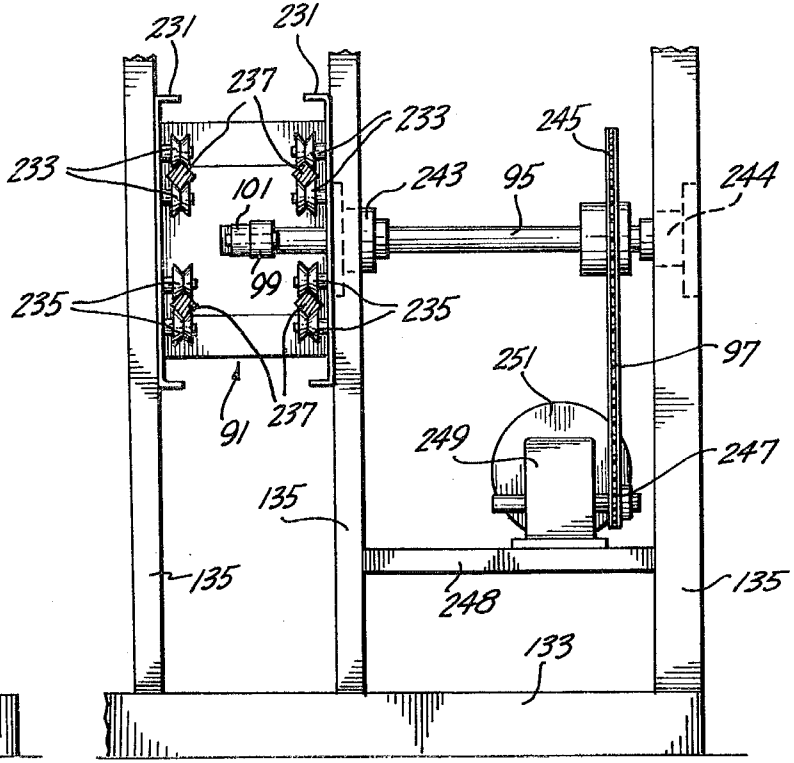
FIG. 10 is a cross-sectional view of an H-section carton forming machine formed in accordance with the invention taken along line 10—10 of FIG. 2.
Figure 9:
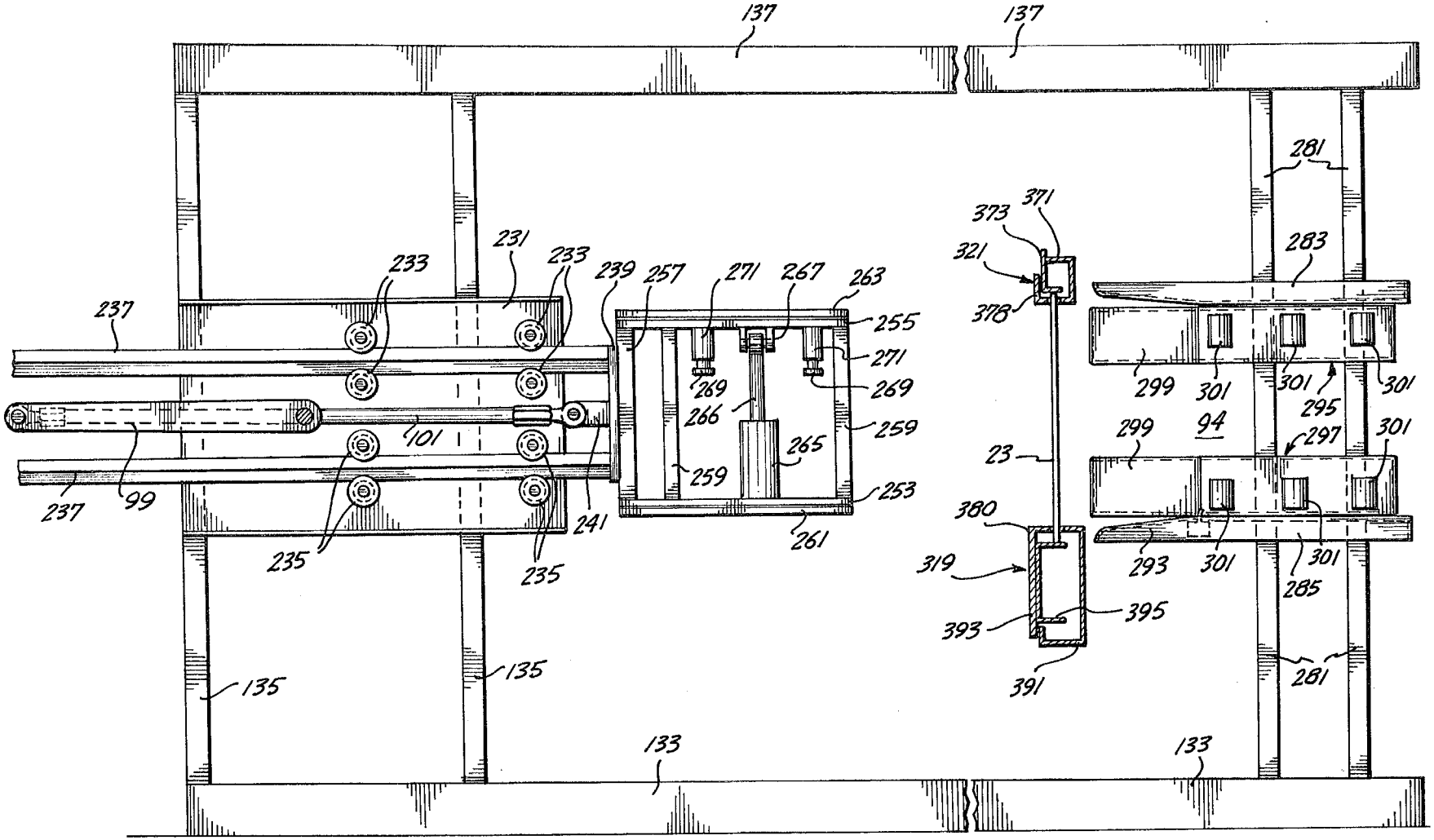
FIG. 9 is a cross-sectional view of an H-section carton forming machine formed in accordance with the invention taken along line 9—9 of FIG. 2.

FIGS. 9 and 10 best illustrate the expandable mandrel 91 and the mechanism for supporting and driving the expandable mandrel. Mounted on the inner side of the uprights 135 that support the plates on which the pick-off mechanism 77 are mounted, are a pair of further plates 231. Mounted on the facing surfaces of the further plates 231 are two horizontally aligned pairs of upper rollers 233 and two horizontally aligned pairs of lower rollers 235. The upper and lower rollers have circumferential V grooves and are mounted for rotation on axles that project orthogonally outwardly from the plates 231. The rollers making up each pair are spaced from one another by an amount adequate for their grooves to slidably receive opposing corners of a square tube 237. As a result, four horizontally oriented square tubes 237 are slidably supported by the eight pairs of rollers. One end of the square tubes 237 are affixed to a vertical plate 239, which is attached to the rear surface of the expandable mandrel 91. Mounted in the center of the plate 239 is a bracket 241 to which one end of the link 101 is horizontally pinned. As previously described, the other end of the link 101 is horizontally pinned to a crank arm 99, as shown in FIG. 10.

The other end of the crank arm 99 is affixed to the inner end of the shaft 95. The shaft is journaled in bearings 243 and 244 mounted in a pair of suitably positioned uprights 135. Mounted on the shaft 95 is a sprocket 245, which is connected by the chain 97 to a further sprocket 247 mounted on the output shaft of a gear box 249. The input shaft of the gear box 249 is connected to an electric motor 251. In a conventional manner, when the electric motor is energized, the gear box 249 transfers power to the shaft 95 via the sprocket-chain assembly. As the shaft 95 rotates, the crank arm-link assembly converts rotary shaft motion to reciprocating expandable mandrel motion. As a result, the expandable mandrel 91 moves through a path of travel that starts from a retracted position whereat the crank arm 99 and the rod 101 are in overlapping alignment (illustrated in FIG. 9). As the crank arm moves, the expandable mandrel 91 is moved toward the main body blank leg. The end of the path of travel occurs when the expandable mandrel 91 lies inside of the final forming die 94 hereinafter described in more detail. Thereafter, the expandable mandrel returns to its retracted position. The entire path of travel is covered once for each revolution of the shaft 95. The upper and lower pairs of rollers 230 and 235 coact with the square tubes to support the expandable mandrel and assure that the mandrel reciprocates along a horizontal path of travel.

As illustrated in FIGS. 2, 9 and 10, the expandable mandrel 91 is generally a rectangular parallelopiped having a vertical slot 92. More specifically, the expandable mandrel 91 includes a slotted base plate 253 and a slotted top plate 255. Extending between the base and top plates is a back plate 257 to which the vertical plate 239 is affixed by, bolting or welding, for examples. Also extending between the base and top plates 253 and 255 are a plurality of vertical columns 259. The vertical columns are positioned so as to lie outside of the region defined by the vertical slot. Affixed to the lower surface of the base plate 253 is a slotted base reinforcing plate 261. Overlying the top plate 255 is a slotted pedestal plate 263. The slots in the various plates are, of course, all vertical and aligned. The slots in the plates define the vertical slot 92.

Mounted on the base plate 253 are a pair of vertically oriented pneumatic actuators 265, one located on either side of the vertical slot. The vertical shafts of the pneumatic actuators 265 are pinned to yokes 267 attached to the bottom of the pedestal plate 263 and extending downwardly through apertures in the top plate 255. Further, alignment pins 269 attached to the bottom of the pedestal plate 263 extend downwardly through apertures in collars 271 mounted on the lower surface of the top plate 255. As will be readily appreciated, when the pneumatic actuators 265 are energized, their shafts raise vertically, causing the pedestal plate 263 to rise. This action creates both up and down pressure when the expandable mandrel is located inside of the final forming die 94.

Figure 11A:
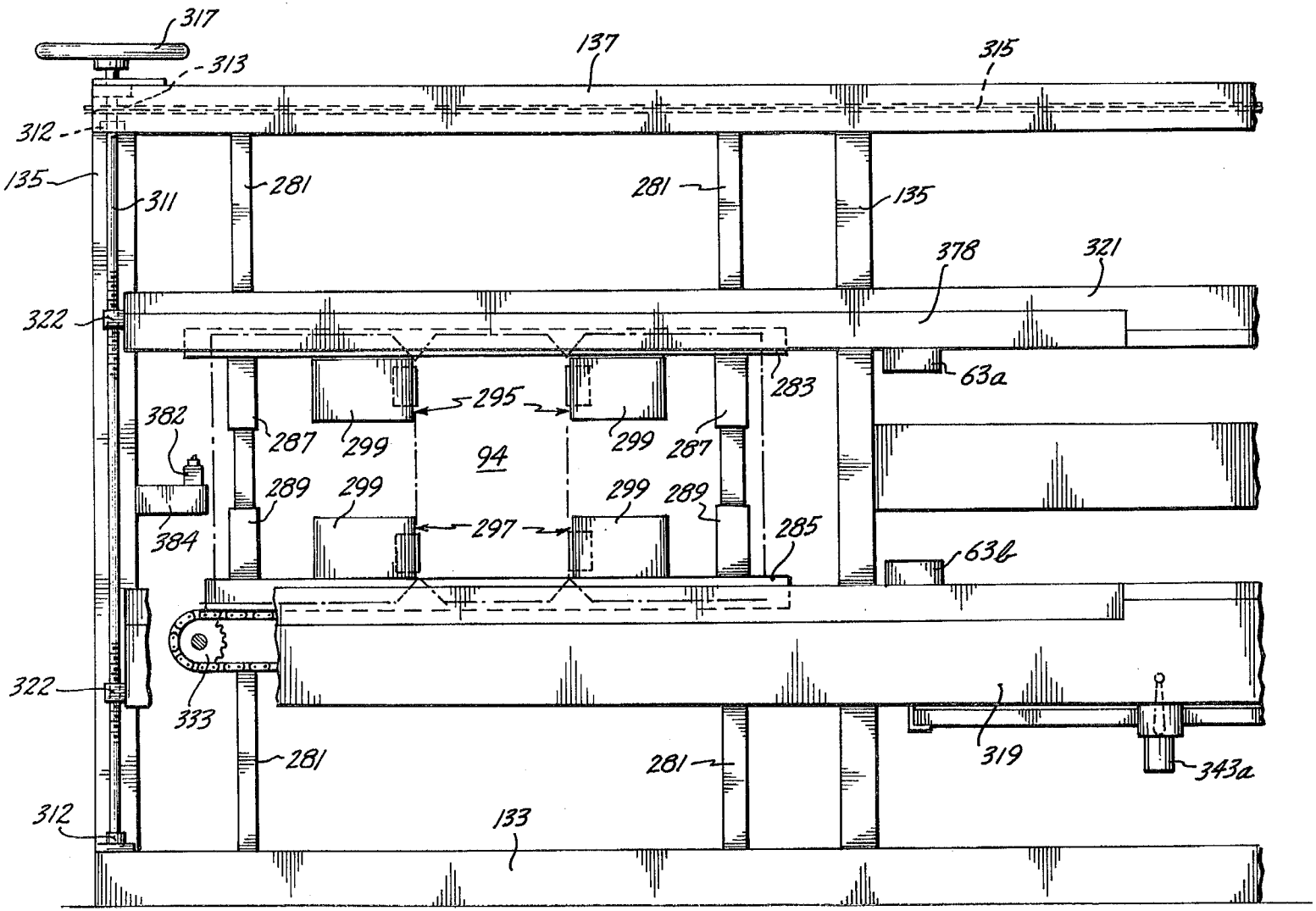
FIGS. 11A and 11B combine to form a composite cross-sectional view of an H-section carton forming machine formed in accordance with the invention taken along line 11—11 of FIG. 2.

The final forming die 94 is best illustrated in FIGS. 9 and 11A. The final forming die includes four vertical posts 281, which support upper and lower die tables 283 and 285. More specifically, the upper die table 283 includes four downwardly projecting elongate collars 287 and the lower die table 285 includes four upwardly projecting elongate collars 289. Each of the upper and lower collars 287 and 289 slidably surrounds a post 281. A suitable locking mechanism (not shown) such as orthogonally mounted locking bolts lock the collars and, thus, the upper and lower die tables, in any desired position. As illustrated in FIG. 9, the sides of the upper and lower die tables 283 and 285 which face the expandable mandrel 91 slightly taper upwardly and downwardly, respectively, whereby upper and lower inclined surfaces 291 and 293 face the expandable mandrel 91. Mounted on the lower surface of the upper die table 283 is a first pair of guide members 295. Mounted on the upper surface of the lower die table 285 is a second pair of guide members 297. The upper and lower pairs of guide members 295 and 297 are aligned with one another. The guide members are formed by vertical plates that are mounted on their associated tables for horizontal movement toward and away from one another. When in a desired position, a locking mechanism (not shown) locks the guide members in place. The ends of the guide members 295 and 297 facing the expandable mandrel 291 include wings 299 that diverge outwardly. Mounted in the nondiverging portion of the guide members are vertically oriented tubes 301. The tubes 301 project through apertures in the guide members and are spring-loaded by flat spring elements (not shown) affixed to the tubes and the outer surface of the guide members so as to create a force pressing the tubes partially through the apertures into the space between the pairs of guide members.

It will be appreciated from the foregoing description and viewing FIGS. 9 and 11A that the final forming die 94 defines a rectangular opening that faces the expandable mandrel and converges to a fixed size. The converging surface is defined by the inclined surfaces 291 and 293 of the tables and the wings 299 of the guide members. The converging surface directs the main body blanks into the adjustably fixed size rectangular opening. Side pressure and ease of entry is enhanced by the spring loaded tubes 301. In addition, small ramps 303 located in the upper and lower tables 283 and 285 just beyond the inclined surfaces 291 and 293, assist in bending the center tabs 49 and 51 of the main body panels 23 around the edges of the outer surfaces of the legs of the H-section. The distance between the die tables is slightly greater than the height of the expandable mandrel and, the distance between the vertical guide members is slightly greater than the width of the expandable mandrel. Differences in height and width are generally equal to twice the thickness of the corrugated cardboard used to form the elements of the carton (e.g., the section and main body blanks).

Figure 11B:
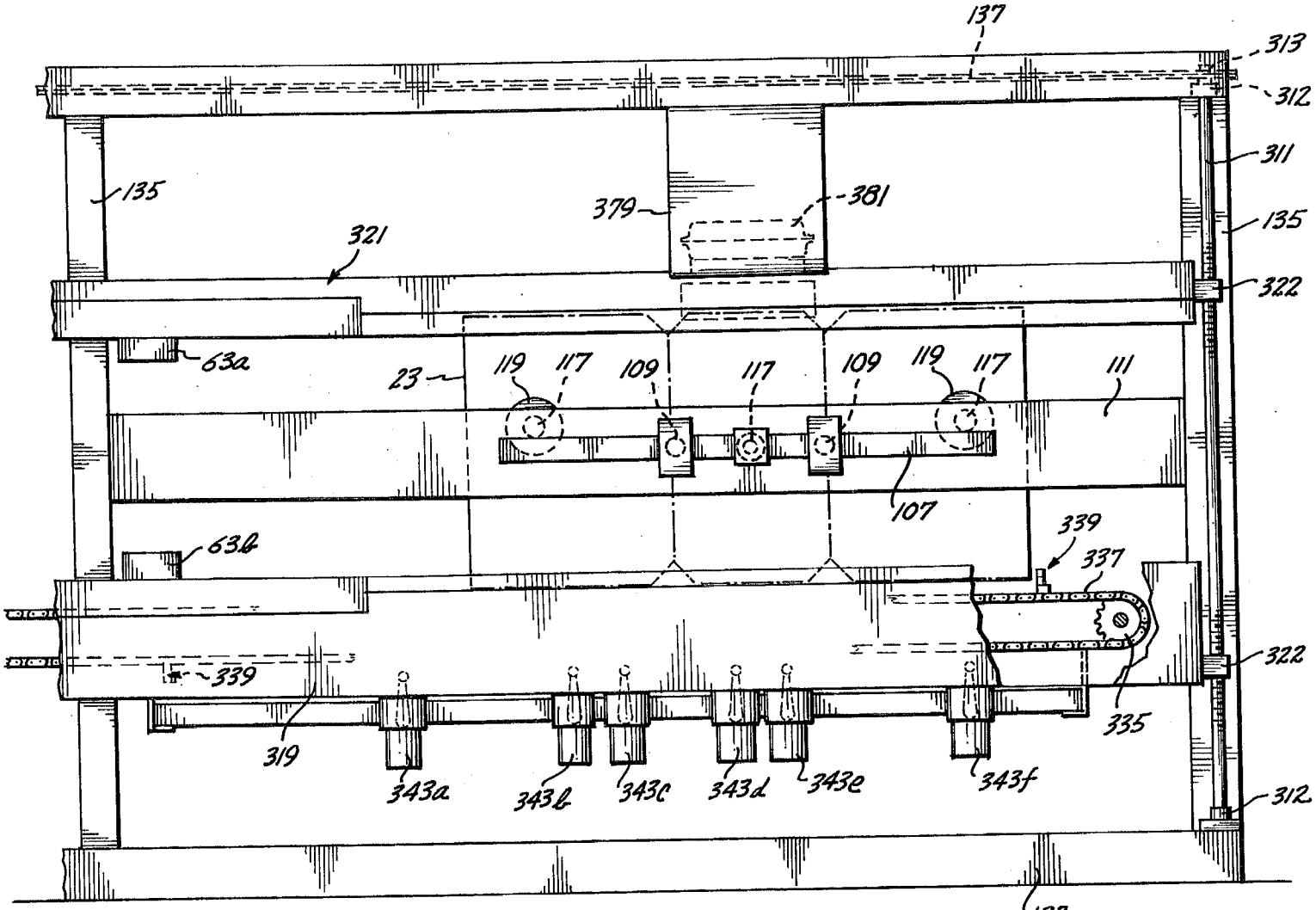
Figure 12:
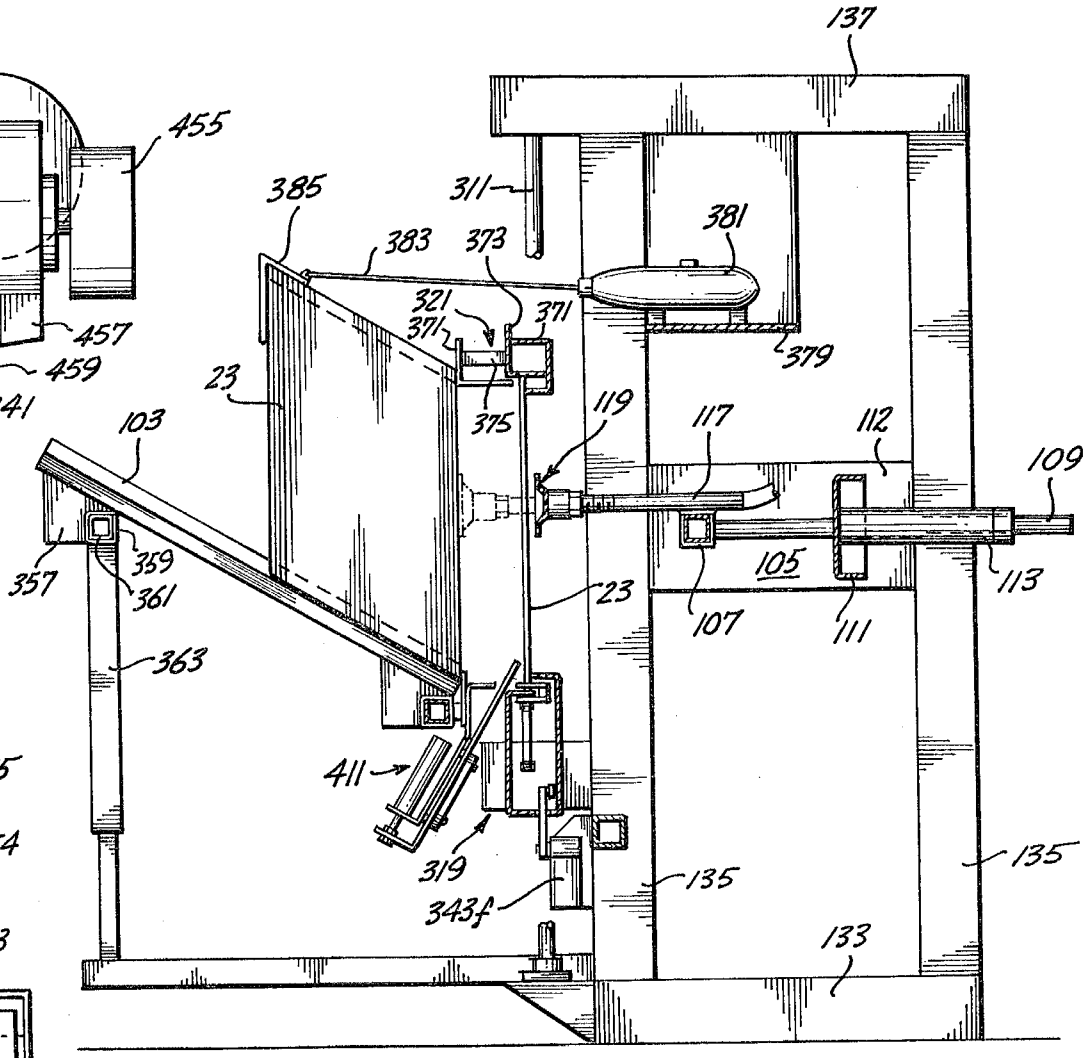
FIG. 12 is a cross-sectional view of an H-section carton forming machine formed in accordance with the invention taken along line 12—12 of FIG. 2.

FIGS. 11A, 11B and 12 illustrate the mechanism for moving a main body blank from a supply of main body blanks, past the tab glue applicators **63*a* and 63*b*, to a position between the U and H-section forming die 87 and the final forming die 94. The main body blank moving mechanism includes a pair of vertically oriented, threaded shafts 311 journaled in bearings 312 mounted in the base 133 and the top 137. One threaded shaft 311 is located at either end of the main body blank leg 73. The threaded shafts 311 define a vertical plane lying between the U and H-section forming die 87 and the final forming die 94. The threaded shafts 311 include a right-handed thread at one end, e.g., the upper end, and a left-handed thread at the other end, i.e., the lower end. A sprocket 313 lying in the top 137 of the framework, is mounted near the top of the threaded shafts 311; and, a chain 315 connects the sprockets together. Mounted on one of the threaded shafts 311 is a hand wheel 317. When the hand wheel 317** is rotated, the related threaded shaft rotates; and the chain-sprocket coupling mechanism causes the other threaded shaft to rotate.

Mounted on the threaded shafts 311, near the lower end thereof, is a lower channel assembly 319. Mounted on the threaded shafts 311, near the upper end thereof, is an upper channel assembly 321. More specifically, the lower and upper channel assemblies have nuts 322 mounted on their outer ends. The nuts are threaded onto the threaded shafts 311. Due to the different nature of the top and bottom threads, when the threaded shafts 311 are rotated in one direction or the other, the lower and upper channel assemblies 319 and 321 move toward or away from one another, depending upon the direction of rotation.

As described hereinafter in detail, the upper and lower channel assemblies are formed of structural items having various cross-sectional configurations. The lower channel assembly is hollow and houses a mechanism for moving a main body blank. More specifically, mounted inside of the lower channel assembly 319 near the ends thereof are first and second sprockets 333 and 335. The sprockets are vertically oriented and a link chain 337 couples them together. Mounted on the chain are a plurality of outwardly extending dogs 339. When the chain is driven as hereinafter described, the upper part moves from right to left as viewed in FIG. 11B and the lower part moves from left to right.

Horizontally mounted beneath the chain 337 near the outer end of the main body blank leg 73 is a square tube 341. Slidably mounted on the square tube 341 are six microswitches **343*a, b, c, d, e* and *f*. Locking mechanisms (not shown) such as clamp bolts, for example, are provided for locking the microswitches in any designated position along the length of the tube 341. The actuating arms of the microswitches are positioned such that they are impinged on by left-to-right moving dogs 339, as the lower part of the chain moves from left-to-right. The microswitches control the application of glue by the glue applicators such that glue is only sprayed onto the tabs. More specifically, as a main body blank is moved from right-to-left, as herein described, a left-to-right moving dog actuates the microswitches. The first microswitch 343a is actuated by a left-to-right moving dog when the leading edge of a main body blank reaches the glue applicators. When actuated, the first microswitch causes glue to be sprayed by the glue applicators. When the first set of U-shaped indentations 28 and 31 reach the glue applicators, the second microswitch 343b is actuated by the same left-to-right moving dog 339. The second microswitch stops the application of glue. The third microswitch 343c restarts the application of glue at the same time that the leading edge of the center tabs 49 and 51 reach the glue applicators 63a and 63b. When the second set of U-shaped indentations 29 and 33 reach the glue applicators, the fourth microswitch 343d stops the application of glue. The fifth microswitch 343e starts the application of glue when the leading edge of the trailing set of tabs 55 and 59** reach the glue applicators; and, the sixth microswitch stops the glue application when the trailing edge of the main body blank reaches the glue applicators. As a result, glue is only applied to the tabs of the main body blank. Consequently, overspray is avoided.

As previously described and more clearly illustrated in FIGS. 11B and 12, the invention includes a withdrawal mechanism 105. The withdrawal mechanism 105 includes the horizontal frame member 111, which is mounted on a pair of plates 349 supported by suitably positioned uprights 135. Mounted on the back side of the frame member 111 is the pneumatic actuator 113. The guide rods 109 are mounted in the guide collars (not shown), which are also mounted on the back-side of the frame member 111. The pneumatic actuator and the guide rods are all horizontally oriented and their adjacent ends are affixed to the horizontal bar 107. Mounted atop the horizontal bar 107 are the vacuum tubes 117. As described above, when the pneumatic actuator is energized, its shaft moves the horizontal bar 107 and the vacuum tubes toward the supply of main body blanks. When the suction cups mounted on the outer ends of the vacuum tubes impinge on the innermost one of the supply of main body blanks 23, they become attached thereto. Subsequent reverse movement of the shaft of the pneumatic actuator 113 moves the innermost main body blank away from the support to a position in the hereinafter described channels formed by the upper and lower channel assemblies 321 and 319.

Figure 13:
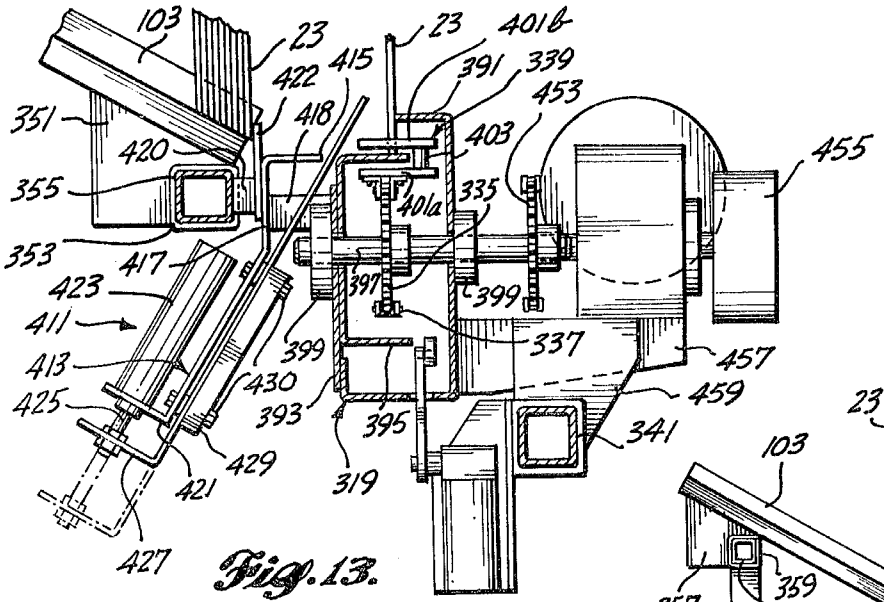
FIG. 13 is an enlarged view of a portion of FIG. 12 illustrating a gate mechanism for creating a channel along which the lower edge of a main body blank moves and the mechanism for moving a main body blank; and, FIG. 14 is a top plan view illustrating the drive mechanism for moving a main body blank.

The inclined square tubes 103 that support the supply of main body blanks 23 are best illustrated in FIGS. 12 and 13. The square tubes are oriented such that one pair of opposing corners lie in a vertical plane. The inner end of the square tubes 103 are supported by the lower channel assembly 319. The support mechanism includes plates 351 that extend downwardly from the inner ends of the tubes. The plates 351 support square aperture collars 353 that lie orthogonal to the axis of the square tubes 103 and parallel to the lower channel assembly 319. The square aperture collars 353 are slidably mounted on a square tube 355. The square tube 355 is affixed to the lower channel assembly 319 in the manner hereinafter described so as to lie parallel to the lower channel assembly. Because the collars 353 are slidably mounted, the separation between the square tubes 103 is adjustable. A locking mechanism (not shown) is provided for locking the collars in any desired position. The outer ends of the square tubes 103 are supported by a generally similar assembly. More specifically, plates 357 extend downwardly from the outer ends of the tubes. The plates support square aperture collars 359 that lie orthogonal to the square tubes 103 and parallel to the lower channel assembly 319. The square aperture collars are mounted on a square support tube 361. The square support tube 361 is supported by a vertical telescoping column 363, the bottom end of which is supported by an arm 365 that extends outwardly from atop the base 133. While not illustrated, the telescoping column 353 also includes a suitable lock mechanism for locking it in a fixed position. As before, the column and collar locking mechanisms may comprise orthogonally mounted lock screws or bolts.

It will be appreciated from the foregoing description that the square tubes 103 that support the supply of main body blanks 23 can be both raised and lowered (as the lower channel assembly 319 is raised and lowered). In addition, the separation between the square tubes 103 can bge controlled so that varying V-shaped indentation separation distances can be accommodated.

As can be seen in FIG. 12, the inner upper corner of the supply of main body blanks 23 rests against the outer surface of the upper channel assembly 321. The supply of main body blanks is maintained vertical by a retraction reel 381 similar to the retraction reels 185 used with the section blanks. More specifically, a shelf 379 is hung from the top 137 of the framework. Mounted on the shelf 379 is the spring-loaded retraction reel 381. A cable 383 extends outwardly from the retraction reel 381 and has an arcuate angle hook 385 affixed to its outer end. The hook 385 overlies the upper, outer corner of the supply of main body blanks. The force applied to the cable 383 by the retraction reel 381 is adequate to maintain the supply of main body blanks vertical, as illustrated in FIG. 12.

When viewed in cross section from the outer end of the main body blank leg 78 (FIG. 12), the upper channel assembly includes a reverse C-channel 371 i.e., a C-channel mounted such that its legs project outwardly. The upper leg of the C-channel 371 is longer than the lower leg. The upper leg and part of the cross member of the C-channel are enclosed by an L-angle 373. That is, the lower leg of the L-angle lies above the lower leg of the C-channel 371. Spacers 375 support a further L-channel 377 outwardly from the first L-channel 373. The lower leg of the further L-channel 377 lies spaced below the lower leg of the first L-channel 373, but above the lower leg of the C-channel 371. The adjacent edges of the lower leg of the further L-channel and the lower leg of the C-channel are horizontally spaced by an amount slightly greater than the thickness of the corrugated cardboard forming main body blanks 23. Thus, an upper channel is formed. It is the vertical leg of the further L angle 377 against which the upper inner corner of the supply of main body blanks 23 rests.

FIG. 13 best illustrates the cross-sectional configuration of the lower channel assembly 318 in the region of the main body blank supply. As illustrated in FIG. 13, the lower channel assembly 319 includes a reverse C-channel 391 having a long lower leg and a short upper leg. Further, the outer end of the lower leg has an upwardly protruding flange. Mounted on the flange is a vertical plate 393. Mounted on the inside of the vertical plate is a C-channel 395. The legs of the C-channel lie between the legs of the reverse C-channel 391. Passing through the plate, the C-channel and the reverse C-channel, is a drive shaft 397, which is journaled in a pair of bearings 399 mounted on the outer surfaces of the plate 393 and the reverse C-channel 391. Mounted on the drive shaft 397 is the second sprocket 335.

The dogs 339, as illustrated in FIG. 13, are generally U-shaped in configuration. That is, the dogs include a pair of arms 401*a* and 401*b*. One end of the arms 401*a* and 401*b* are joined together by a spacer 403. The other end of one of the arms 401*a* is attached to the outer surface of the chain 337. The outer arm 401*b* lies parallel to and outwardly of the first arm 401*a*. The assembly is positioned such that the arms 401*a* and 401*b* lie on either side of the legs of the C-channel 395. Thus, the outer arm 401*b* rides above the upper surface of the C-channel, when a dog moves from right-to-left in FIGS. 11A and 11B. Contrariwise the outer arm lies beneath the lower surface of the C-channel when a dog moves from left-to-right. As will be better understood from the following discussion, main body blanks rest on the upper surface of the C-channel 394. Thus, the other arms 401*b* of the dogs 399 are positioned so as to impinge on the trailing edge of a main body blank, near the lower corner, when moved from right-to-left. As a result, when the chain 337 is driven, as hereinafter described, a dog pushes a main body blank along the channels formed by the upper and lower channel assemblies.

As also shown in FIG. 13, the arms of the microswitches 343 project upwardly through a slot (or suitably positioned) apertures in the lower leg of the reserve C-channel 391 so as to lie adjacent to the edge of the lower leg of the C-channel 395. As a result, the upper end of the arm of the microswitch are in a position such that dogs 339 can impinge thereon. Such impingement creates the previously described switching action that controls the glue applicators 63*a* and 63*b*.

In order to prevent more than a main body blank from leaving the channels formed by the upper and lower channel assemblies after being moved to a pick-up position, a channel closing mechanism 411 is provided. The channel closing mechanism 411 is best illustrated in FIG. 13 and comprises a generally Z-shaped support member 413. The generally Z-shaped support member includes a horizontal upper leg 415. The upper leg 415 extends outwardly for a short distance and merges into a downwardly projecting vertical leg 417 that ends beneath the square tube 355, which supports the inner end of the inclined square tubes 103. The downwardly projecting arm 417 is spaced from the vertical plate 393 of the lower channel assembly 319 by inner spacers 418. Bolts extending through the inner spacers attach the downwardly projecting arm 417 to the vertical plate 393. Outer spacers 420 space the square tube 355 from the downwardly projecting arm 417; and bolts extending through the spacers attach these items together. Further, the downwardly projecting arm 417 supports a vertical gate plate 422. The upper edge of the vertical gate plate 422 extends slightly above the lower inner corner of the supply of main body blanks 23 to prevent more than one main body blank from being pulled away from the supply at the same time.

The lower end of the downwardly projecting arm 417 of the generally Z-shaped support member 413 merges into an outwardly projecting arm 419. The outwardly projecting arm 419 also projects downwardly. A flange 421 projects outwardly and upwardly from the lower end of the outwardly projecting arm 419.

Mounted on the upper surface of the flange 421 is a pneumatic actuator 423. The shaft 425 of the pneumatic actuator 423 extends through the flange and its outer end affixed to the outwardly projecting flange of an L-shaped plate 427. More specifically, the L-shaped plate 427 has a long and a short leg. The short leg is attached to the outer end of the shaft 425 of the pneumatic actuator 423. The long leg of the L-shaped plate 427 lies along side the outwardly projecting arm 419 of the generally Z-shaped support member 413 and is supported by a slide block 429. More specifically, the slide block 429 is spaced from the outwardly diverging arm 419 of the generally Z-shaped support member 413 by spacers. The spacers lie in a slot or slots formed in the long arm of the L-shaped plate 427. Bolts 430 passing through the spacers attach the slide block to the outwardly diverging arm 419. The positioning of these elements is such that the long arm of the L-shaped plate projects upwardly at an inclined angle so as to lie between the upper leg 415 of the generally Z-shaped support member 413 and the outer upper corner of the C-channel 395 of the lower channel assembly 319. The pneumatic actuator moves the L-shaped plate between open and closed postitions along an axis defined by the plane of long arm of the L-shaped plate. In the plate closed position illustrated by the solid lines in FIG. 13, the upper end of the long arm lies between the supply of main body blanks 23 and the channel in which a single main body blank 23 is moved. In fact, gthe upper region of the long arm more or less defines the outer side of the channel. In the plate open position, illustrated by the dashed lines in FIG. 13, the L-shaped plate is withdrawn to a position where the upper edge of the long arm lies in the aperture between the upper arm 415 of the generally Z-shaped support member 413 and the upper outer corner of the C-channel 395 of the lower channel assembly 319. In this position, the lower edge of a main body blank is free to slide away from the supply of main body blanks to a position in the channel defined by the upper and lower channel assemblies 321 and 319 when the withdrawal mechanism 105 is actuated in the manner previously described. When this occurs, the upper end of the main body blank bends slightly and slides under the lower surface of the further L-channel 377 of the upper channel assembly. The resilience of the main body blank causes its upper end to achieve a substantially planar shape after the upper channel is reached.

Downstream of the region wherein the main body blanks enter the channels defined by the lower an upper channel assemblies, the further L-shaped channel 377 of the upper channel assembly 321 ends and is replaced by narrower L-shaped channel 318. See FIGS. 8 and 11A. Further, the lower channel assembly includes an inverted L-shaped channel 380 downstream of the channel closing mechanism 411. As a result, relatively narrow channels lie between the region where the main body blanks enter the channel and the downstream end of the channels.

Movement of the chain 337 and, thus, a main body blank ends when the leading edge of a main body blank impinges on the arm of a switch 382 mounted on a bracket 384 affixed to a suitably positioned upright 135. When the switch is actuated, the main body blank is aligned between the U and H-section forming die 87 and the final forming die 94.

Figure 14:
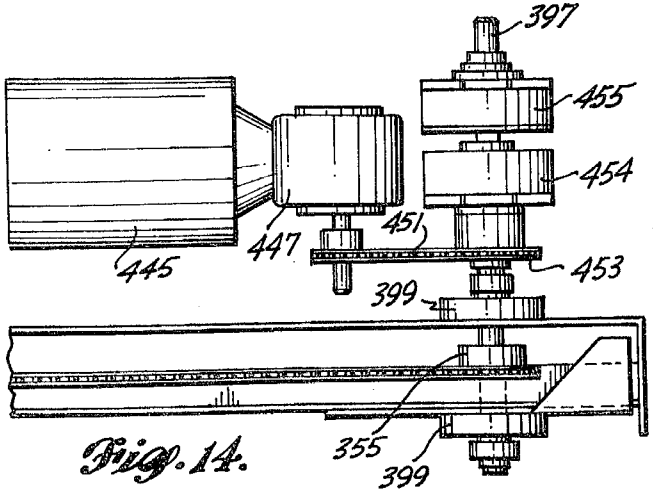

FIGS. 13 and 14 illustrate the mechanism for driving the chain 337 on which the dogs 339 are mounted. The driving mechanism comprises a motor 445 having its shaft connected to the input shaft of a gear box 447. The output shaft of the gear box supports a sprocket 449. A short drive chain 451 connects the gear box sprocket 449 to a clutch sprocket 453. The clutch sprocket 453 is clutched via a clutch 454 to the drive shaft 397. In the illustrated embodiment of the invention the cluth is a co-axial clutch i.e., both the clutch sprocket 453 and the drive shaft rotate about the same axis. An example of such a clutch is the SF-400 clutch unit sold by the Warner Brake Co. of Belort, Wisconsin. In addition, mounted on the drive shaft 397 is a brake 455. The brake 455 is mounted on the side of the clutch 454 opposed to the side on which the clutch sprocket 453 is mounted. An example of a suitable brake is the PB-400 Brake Unit also sold by the Warner Brake Co. The gear box and clutch are supported by inverted U-shaped channels 457 affixed to the reverse C-channel 391 of the lower channel assembly. As illustrated in FIG. 14, the inverted U-channels support downwardly projecting arms 459 which, in turn, support the horizontal bar 451 on which the microswitches 343*a–f* are mounted.

It will be appreciated from the foregoing description that the invention provides a mechanism for forming cartons that include H-sections. In particular, the invention is suitable for automatically forming Bliss style trays with integral H-dividers. Not only does the invention rapidly and quickly form such boxes, it is adaptable to form such boxes of varying sizes. That is, suitably adjusting the upper and lower tables and upper and lower channel assemblies, using appropriately sized rectangular and expandable mandrels, and suitably positioning the tables of the final forming die allows a wide variety of different sizes of cartons to be formed utilizing a single machine.

While a preferred embodiment of the invention has been illustrated and described, it will be appreciated that various changes can be made therein without departing from the spirit and scope of the invention. Hence, the invention can be practiced otherwise than as specifically described herein.

The embodiments of the invention in which an exclusive property or privilege is claimed are defined as follows:

1. An H-section carton forming machine for forming an H-section carton from two section blanks and a main body blank, said H-section carton forming machine comprising:

(A) section forming means for forming two section blanks into U-shapes and affixing the backs of the cross-members of the U-shapes together to form an H-section, said section forming means comprising:

(1) first glue means for applying glue to one surface of the portions of said section blanks that define the cross-members of said U-shapes;

(2) pickoff means for moving said two section blanks past said first glue means; and, (3) bending and attaching means for bending said two section blanks into U-shapes and pressing the cross-members of the U-shapes together; and, (B) combining means for wrapping a main body blank around said H-section.

2. An H-section carton forming machine as claimed in claim 1 wherein said section forming means also includes a section blank supply means for supplying said section blanks.

3. An H-section carton forming machine as claimed in claim 1 wherein said combining means comprises:

second glue means for applying glue on one surface of a main body blank adjacent to selected peripheral edges of said main body blank;

movement means for moving a main body blank past said second glue means; and, final forming means for wrapping said main body blank about an H-section such that the portions of said main body blank having glue applied thereto overlie the outer surfaces of the legs of said H-section.

4. An H-section carton forming machine as claimed in claim 3 wherein said section forming means also includes a section blank supply means for supplying said section blanks.

5. An H-section carton forming machine as claimed in claim 4 wherein said section blank supply means includes two supply trays, each of which supports a supply of section blanks, and wherein said pickoff means picks off one section blank from each of said two supply trays.

6. An H-section carton forming machine as claimed in claim 5 wherein said two supply trays face one another and wherein said pickoff means simultaneously picks off one section blank from each of said two supply trays.

7. An H-section carton forming machine as claimed in claim 6 wherein said bending and attaching means comprises a section forming die and a pair of opposed rectangular mandrels lying on opposite sides of said die; and, wherein said pickoff means positions one of said section blanks between said section forming die and one of said rectangular mandrels and the other of said section blanks between said section forming die and the other of said rectangular mandrels after said pickup means moves said section blanks past said first glue means.

8. An H-section carton forming machine as claimed in claim 7 wherein said combining means includes a main body blank supply means for supplying main body blanks to said movement means.

9. An H-section carton forming machine as claimed in claim 8 wherein:

said final forming means includes a final forming die aligned with said section forming die;

said movement means moves a main body blank from said main body blank supply means to a position between said section forming die and said final forming die; and, said final forming means also includes a pick-up mandrel means for picking up an H-section from said section forming die, ramming said H-section into a main body blank located between said section forming die and said final forming die, and then ramming said H-section and said main body blank into said final forming die.

10. An H-section carton forming machine as claimed in claim 9 wherein said pick-up mandrel means includes an expandable mandrel.

11. An H-section carton forming machine as claimed in claim 3 wherein said combining means includes a main body blank supply means for supplying main body blanks to said movement means.

12. An H-section carton forming machine as claimed in claim 11 wherein:

said final forming means includes a final forming die aligned with said bending and attaching means;

said movement means moves a main body blank from said main body blank supply means to a position between said bending and attaching means and said final forming die; and, said final forming means also includes a pick-up mandrel means for picking up an H-section from said bending and attaching means, ramming said H-section into a main body blank located between said bending and attaching means and said final forming die, and then ramming said H-section and said main body blank into said final forming die.

13. An H-section carton forming machine as claimed in claim 12 wherein said pick-up mandrel means includes an expandable mandrel.

14. An H-section carton forming machine as claimed in claim 2 wherein said section blank supply means includes two supply trays, each of which supports a supply of section blanks, and wherein said pickoff means picks off one section blank from each of said two supply trays.

15. An H-section carton forming machine as claimed in claim 14 wherein said two supply trays face one another and wherein said pickoff means simultaneously picks off one section blank from each of said two supply trays.

16. An H-section carton forming machine as claimed in claim 15 wherein said bending and attaching means comprises a section forming die and a pair of opposed rectangular mandrels lying on opposite sides of said die; and, wherein said pickoff means positions one of said section blanks between said section forming die and one of said rectangular mandrels and the other of said section blanks between said section forming die and the other of said rectangular mandrels after said pickup means moves said section blanks past said first glue means.

17. An H-section carton forming machine for forming an H-section carton from two section blanks and a main body blank, said H-section carton forming machine having an L-shape silhouette and comprising:

(A) section forming means lying along one of the legs of said L-shape, said section forming means including first glue applying means for applying glue to the center region of two section blanks and forming means for forming said two section blanks into U-shapes and joining the center regions of said U-shaped sections together so as to form an H-section, said section forming means including:

(1) pickoff means for moving said two section blanks past said first glue applying means; and, (2) bending and attaching means for bending said two section blanks into U-shapes and pressing the center regions of the U-shapes together;

(B) main body blank means lying along the other leg of said L-shape, said main body blank means including second glue applying means for applying glue to predetermined surface regions located adjacent to selected edges of a main body blank and positioning means for positioning said main body blank at the intersection of said legs of said L-shape; and, (C) combining means located at the intersection of said legs of said L-shape for wrapping a main body blank around an H-section such that said predetermined outer surface regions of said main body blank to which glue is applied overlie the outer surface of the legs of said H-section and are attached thereto.

18. An H-section carton forming machine as claimed in claim 17 wherein said section forming means also includes a section blank supply means for supplying said section blanks, said section blank supply means located along said one leg of said L-shape.

19. An H-section carton forming machine as claimed in claim 18 wherein said section blank supply means includes two supply trays, each of which supports a supply of section blanks, and wherein said pickoff means picks off one section blank from each of said two trays.

20. An H-section carton forming machine as claimed in claim 19 wherein said supply trays are located on opposite sides of said one leg and face one another, and, wherein said pickoff means simultaneously picks off one section blank from each of said two supply trays.

21. An H-section carton forming machine as claimed in claim 20 wherein said bending and attaching means comprises a section forming die and a pair of opposed rectangular mandrels lying on opposite sides of said die; and, wherein said pickoff means positions one of said section blanks between said section forming die and one of said rectangular mandrels and the other of said section blanks between said section forming die and the other of said rectangular mandrels after said pickup means moves said section blanks past said first glue applying means.

22. An H-section carton forming machine as claimed in claim 21 wherein said main body blank means includes a main body blank supply means for supplying main body blanks to said positioning means.

23. An H-section carton forming machine as claimed in claim 22 wherein:

said combining means includes a final forming die aligned with said section forming die;

said positioning means moves a main body blank from said main body blank supply means to a position between said section forming die and said final forming die; and, said combining means also includes a pick-up mandrel means for picking up an H-section from said section forming die, ramming said H-section into a main body blank located between said section forming die and said final forming die, and then ramming said H-section and said main body blank into said final forming die.

24. An H-section carton forming machine as claimed in claim 23 wherein said pick-up mandrel means includes an expandable mandrel.

25. An H-section carton forming machine as claimed in claim 22 wherein said bending and attaching means comprises a section forming die and a pair of opposed rectangular mandrels lying on opposite sides of said die; and, wherein said pickoff means positions one of said section blanks between said section forming die and one of said rectangular mandrels and the other of said section blanks between said section forming die and the other of said rectangular mandrels after said pickup means moves said section blanks past said first glue applying means.

26. An H-section carton forming machine as claimed in claim 17 wherein said main body blank means includes a main body blank supply means for supplying main body blanks to said positioning means.

27. An H-section carton forming machine as claimed in claim 26 wherein:

said combining means includes a final forming die aligned with said forming means;

said positioning means moves a main body blank from said main body blank supply means to a position between said forming means and said final forming die; and, said combining means also includes a pick-up mandrel means for picking up an H-section from said section means, ramming said H-section into a main body blank located between said forming means and said final forming die, and then ramming said H-section and said main body blank into said final forming die.

28. An H-section carton forming machine as claimed in claim 27 wherein said pick-up mandrel means includes an expandable mandrel.

* * * * *

UNITED STATES PATENT AND TRADEMARK OFFICE

CERTIFICATE OF CORRECTION

PATENT NO. : 4,283,188

DATED : August 11, 1981

INVENTOR(S) : Conrad C. Wingerter et al.

It is certified that error appears in the above-identified patent and that said Letters Patent are hereby corrected as shown below:

Column 5, line 13: "heighth" should read --height--

Column 5, line 15: "heighth" should read --height--

Column 5, line 16: "heighth" should read --height--

Column 5, line 63: "applications" should read --applicators--

Column 6, line 58: "pneumtic" should read --pneumatic--

Column 7, line 17: "whichis" should read --which is--

Column 7, line 39: "horiziontal" should read --horizontal--

Column 8, line 28: "chennal" should read --channel--

Column 16, line 17: "bge" should read --be--

Column 18, line 24: "gthe" should read --the--

Column 18, line 45: "an" should read --and--

Column 19, line 2: "cluth" should read --clutch--

Column 22, line 47: "Claim 22" should read --Claim 17--

Signed and Sealed this

*Twenty-fourth* Day of *November 1981*

[SEAL]

*Attest:*

GERALD J. MOSSINGHOFF

*Attesting Officer* *Commissioner of Patents and Trademarks*